US007591467B2

(12) United States Patent
Terada

(10) Patent No.: US 7,591,467 B2
(45) Date of Patent: Sep. 22, 2009

(54) SHEET DETECTING DEVICE FOR IMAGE RECORDING APPARATUS

(75) Inventor: Kohei Terada, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 164 days.

(21) Appl. No.: 11/540,178

(22) Filed: Sep. 29, 2006

(65) Prior Publication Data

US 2007/0075484 A1 Apr. 5, 2007

(30) Foreign Application Priority Data

Sep. 30, 2005 (JP) ..... 2005-286595

(51) Int. Cl.
*B65H 5/02* (2006.01)
*B65H 5/04* (2006.01)

(52) U.S. Cl. ..... 271/274; 271/273

(58) Field of Classification Search ..... 271/272, 271/273, 274, 275, 314; 340/673, 674, 675
See application file for complete search history.

(56) References Cited

U.S. PATENT DOCUMENTS 4,256,299 A * 3/1981 Hogenson ..... 271/262
4,638,991 A * 1/1987 Kato ..... 271/272
4,798,374 A * 1/1989 Ito ..... 271/9.09
6,011,948 A * 1/2000 Amano et al. ..... 399/395

FOREIGN PATENT DOCUMENTS

JP 10175751 6/1998

* cited by examiner

*Primary Examiner*—Patrick H Mackey
*Assistant Examiner*—Patrick Cicchino
(74) *Attorney, Agent, or Firm*—Reed Smith LLP

(57) ABSTRACT

A sheet detecting device includes a follow roller, an urging member, first and second support members, and a detecting unit. The second support member rotatably supports the follow roller and supports the urging member. The second support member is supported on the first support member, allowing the second support member to move to a first position when the drive roller and the follow roller nippingly convey the recording medium, and allowing the second support member to move to a second position upstream of the first position in the conveying direction when the recording medium is separated from the drive roller and the follow roller. The second support member is provided with a detection member that moves with the second support member when the second support member moves between the first position and the second position. The detecting unit detects the detection member, thereby detecting the position of the recording medium.

10 Claims, 15 Drawing Sheets

SHEET DETECTING DEVICE FOR IMAGE RECORDING APPARATUS

CROSS REFERENCE TO RELATED APPLICATIONS

This application claims priority from Japanese Patent Application No. 2005-286595 filed Sep. 30, 2005. The entire content of the priority application is incorporated herein by reference.

TECHNICAL FIELD

The disclosure relates to a sheet detecting device for detecting the position of a sheet-like recording medium conveyed along a conveying path in a conveying direction, and an image recording apparatus having the sheet detecting device.

BACKGROUND

Japanese Patent Application Publication No. HEI-10-175751 discloses a conventional image recording apparatus having a paper sensor for detecting the position of recording paper that is conveyed along a conveying path in a predetermined conveying direction. The paper sensor includes a detection member pivotally supported between a position protruding from a paper-conveying guide into the conveying path and a position retracted from the conveying path; and a paper detecting sensor for detecting pivotal movement of the detection member. When the leading edge of the recording paper contacts the detection member, the detection member is pivotally moved and the recording paper is detected.

SUMMARY

FIGS. 1A through 1C show a portion of the internal structure in an inkjet type image recording apparatus having a platen 102 for supporting a recording paper S at an image-recording position, and a pair of conveying rollers 103 for conveying the recording paper S fed from a paper cassette (not shown) toward the platen 102. This image recording apparatus also includes a carriage 101 that can be moved by sliding in a direction (a direction perpendicular to the surface of the drawings of FIGS. 1A through 1C; hereinafter referred to as the "main scanning direction") orthogonal to a conveying direction for conveying the recording paper S (left-and-right direction in FIGS. 1A through 1C; hereinafter referred to as the "sub-scanning direction"), and a recording head 100 mounted in the carriage 101 so as to confront the platen 102. In the image recording apparatus having this construction, the conveying rollers 103 convey the recording paper S intermittently by predetermined steps, while the carriage 101 conveys the recording head 100 and the recording head 100 ejects ink from nozzles therein onto the recording paper S at times that the recording paper S is halted between intermittent conveying steps, thereby recording an image by predetermined regions.

In the image recording apparatus having this construction, the recording paper S undergoes a registration process prior to the image-recording process described above. Specifically, as a feeding roller (not shown) disposed upstream of the conveying rollers 103 feeds a sheet of the recording paper S onto a conveying path 116, a paper sensor 110 disposed on the conveying path 116 detects the conveyed position of the recording paper S (see FIGS. 1A and 1B). As the recording paper S is conveyed farther and reaches the nip point in the conveying rollers 103 (see F*ig*. 1B, the recording paper S comes to a halt with the leading edge in a state of contact with the nip part between the conveying rollers 103, which are driven in a reverse rotation. At this time, the feeding roller continues to feed the recording paper S so that the leading edge of the recording paper S presses against the nip part of the conveying rollers 103 and flexes within the conveying path 116. Consequently, the entire leading edge of the recording paper S is pushed evenly against the conveying rollers 103, correcting any skew in the recording paper S. When a predetermined time has elapsed after the paper sensor 110 detects the recording paper S, the drive roller 105, which is driven in reverse, is temporarily halted and subsequently driven in a forward rotation a predetermined step for continuously conveying the recording paper S toward the platen 102 until the starting edge of an image-recording region on the recording paper S is aligned with an image-recording position P at which the recording head 100 ejects ink. For example, when the image-recording region begins from the leading edge of the recording paper S, the recording paper S is conveyed continuously until the leading edge of the recording paper S arrives at the position P, as shown in FIG. 1C. Thereafter, the recording head 100 records images while the conveying rollers 103 convey the recording paper S intermittently. A controller (not shown) determines whether the leading edge of the recording paper S has arrived on the upstream side of the conveying rollers 103 and whether the leading edge has arrived at the position P based on detection signals from the paper sensor 110.

The paper sensor 110 is disposed on the conveying path 116 formed of an upper guide 118 and a lower guide 117. More specifically, the paper sensor 110 is disposed directly upstream of the conveying rollers 103. As shown in FIG. 2, the paper sensor 110 is configured of a detection member 111 pivotally supported between a position protruding from the lower guide 117 into the conveying path 116 (represented by the solid line) and a position retracted from the conveying path 116 (represented by the dotted line); and an optical sensor 112, such as a photointerrupter, for detecting the pivotal movement of the detection member 111. The detection member 111 is divided about a support point 113 into a contact part 114 that is contacted by the recording paper S, and a shielding part 115 for blocking light emitted by the optical sensor 112. A spring or other urging means (not shown) elastically urges the detection member 111 in the clockwise direction in FIG. 2 so that the detection member 111 is protruding into the conveying path 116.

While an external force is not applied to the detection member 111, the contact part 114 of the detection member 111 protrudes into the conveying path 116, as indicated by the solid line in FIG. 2, and the shielding part 115 is positioned between a light-emitting element and a light-receiving element of the optical sensor 112. Consequently, the shielding part 115 blocks the optical path in the optical sensor 112, effectively turning off the paper sensor 110. When the leading edge of a sheet of recording paper S conveyed along the conveying path 116 contacts the contact part 114, the detection member 111 pivotally moves counterclockwise so as to retract from the conveying path 116. At this time, the shielding part 115 pivotally moves together with the detection member 111 and moves out of the optical path between the light-emitting element and light-receiving element of the optical sensor 112. Accordingly, the light transmission in the optical sensor 112 is no longer interrupted, effectively turning on the paper sensor 110.

However, in the paper sensor 110 described above, the portion on the leading edge of the recording paper S that collides with the contact part 114 of the probe 111 often curls up or down due to the contact. The amount of deformation in the leading edge depends on the stiffness of the recording paper S. For example, while thick paper may deform very little, thin paper will deform considerably more than the thick paper and, in some cases, may fold over completely. This difference in amount of deformation among different thicknesses of paper produces a different timing for detecting the recording paper S. As a result, the position of the recorded image varies among recording paper of different stiffness.

Further, when the degree or direction of warpage in the leading edge of the recording paper S differs among different sheets of recording paper, the path followed by the leading edge also differs. For example, if the leading edge of the recording paper S curls upward, the recording paper S is conveyed along the upper guide 118. If the leading edge curls downward, the recording paper S is conveyed along the lower guide 117. If the leading edge has no warpage, the recording paper S is conveyed straight through the conveying path 116. The variations in the conveying path lead to fluctuations in the timing at which the recording paper S arrives at the probe 111 so that the recording paper S is detected at different timings. This problem is magnified when performing borderless printing.

In view of the foregoing, it is an object of one aspect of the invention to provide a sheet detecting device capable of improving the precision in detection timing for detecting the position of a conveyed recording medium, and an image recording apparatus equipped with the sheet detecting device.

In order to attain the above and other objects, according to one aspect, the invention provides a sheet detecting device for detecting a position of a recording medium. The sheet detecting device includes a follow roller, an urging member, a first support member, a second support member, and a detecting unit. The follow roller is disposed on a conveying path along which a recording medium is conveyed in a conveying direction. The follow roller receives a rotational force of a drive roller and follows rotation of the drive roller. The urging member applies an urging force to the follow roller for urging the follow roller toward the drive roller. The second support member rotatably supports the follow roller and supports the urging member. The second support member is supported on the first support member, allowing the second support member to move to a first position when the drive roller and the follow roller nippingly convey the recording medium, and allowing the second support member to move to a second position upstream of the first position in the conveying direction when the recording medium is separated from the drive roller and the follow roller. The second support member is provided with a detection member that moves with the second support member when the second support member moves between the first position and the second position. The detecting unit detects the detection member, thereby detecting the position of the recording medium.

According to another aspect, the invention provides an image recording apparatus. The image recording apparatus includes a casing, an image recording unit, and a sheet detecting device for detecting a position of a recording medium, The image recording unit is disposed in the casing for recording an image on a recording medium that is conveyed along a conveying path in a conveying direction. The sheet detecting device includes a follow roller, an urging member, a first support member, a second support member, and a detecting unit. The follow roller is disposed on the conveying path. The follow roller receives a rotational force of a drive roller and follows rotation of the drive roller. The urging member applies an urging force to the follow roller for urging the follow roller toward the drive roller. The first support member is supported by the casing. The second support member rotatably supports the follow roller and supports the urging member. The second support member is supported on the first support member, allowing the second support member to move to a first position when the drive roller and the follow roller nippingly convey the recording medium, and allowing the second support member to move to a second position upstream of the first position in the conveying direction when the recording medium is separated from the drive roller and the follow roller. The second support member is provided with a detection member that moves with the second support member when the second support member moves between the first position and the second position. The detecting unit detects the detection member, thereby detecting the position of the recording medium.

BRIEF DESCRIPTION OF THE DRAWINGS

Illustrative aspects in accordance with the invention will be described in detail with reference to the following figures wherein.

DETAILED DESCRIPTION

A sheet detecting device and an image recording apparatus according to some aspects of the invention will be described while referring to FIGS. 3 through 15. In the following description, the expressions "front", "rear", "upper", "lower", "right", and "left" are used to define the various parts when the image recording apparatus is disposed in an orientation in which it is intended to be used.

Figure 1A:
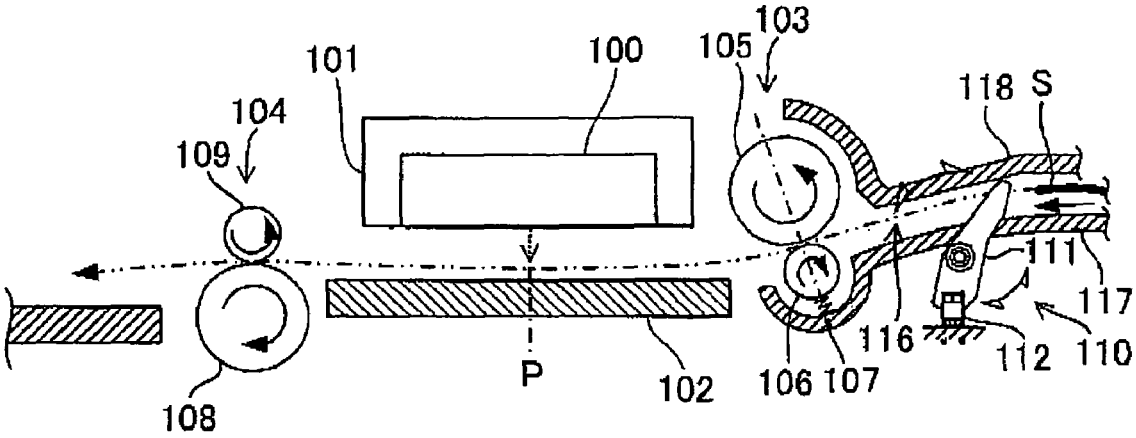
FIGS. 1A through 1C are explanatory diagrams illustrating an example of an image recording apparatus.
Figure 1B:
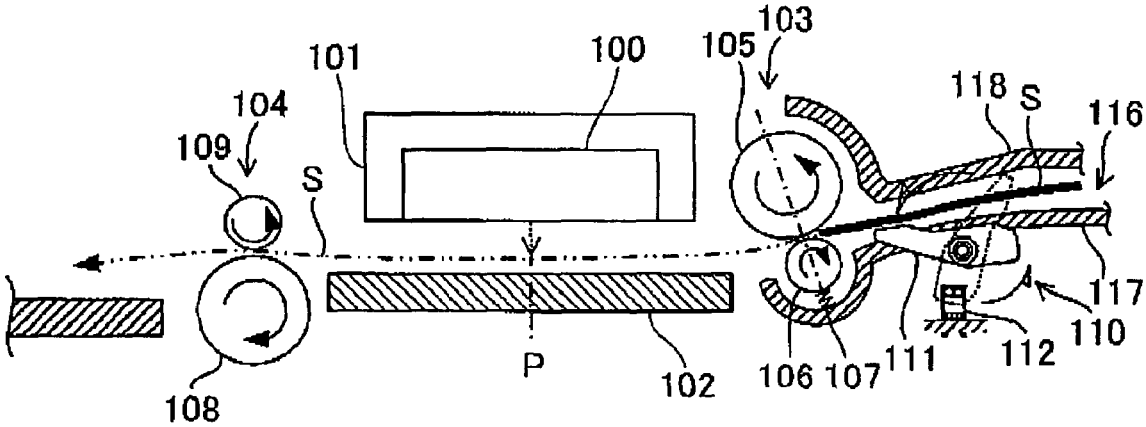
Figure 1C:
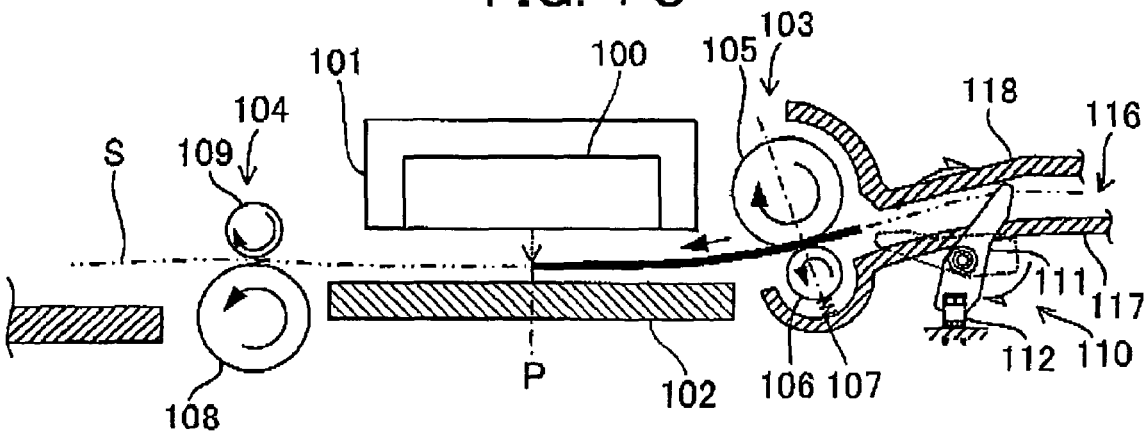
Figure 2:
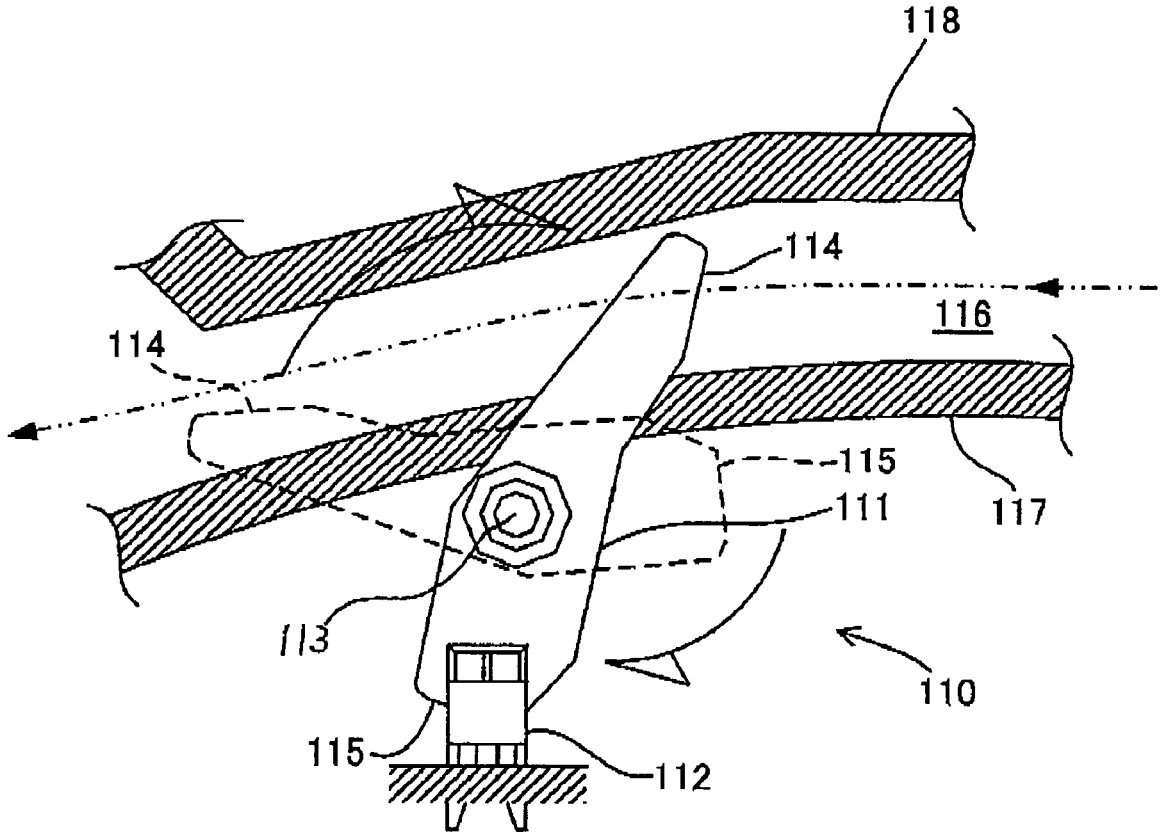
FIG. 2 is an enlarged view of a paper sensor provided in the image recording apparatus shown in FIGS. 1A through 1C.
Figure 3:
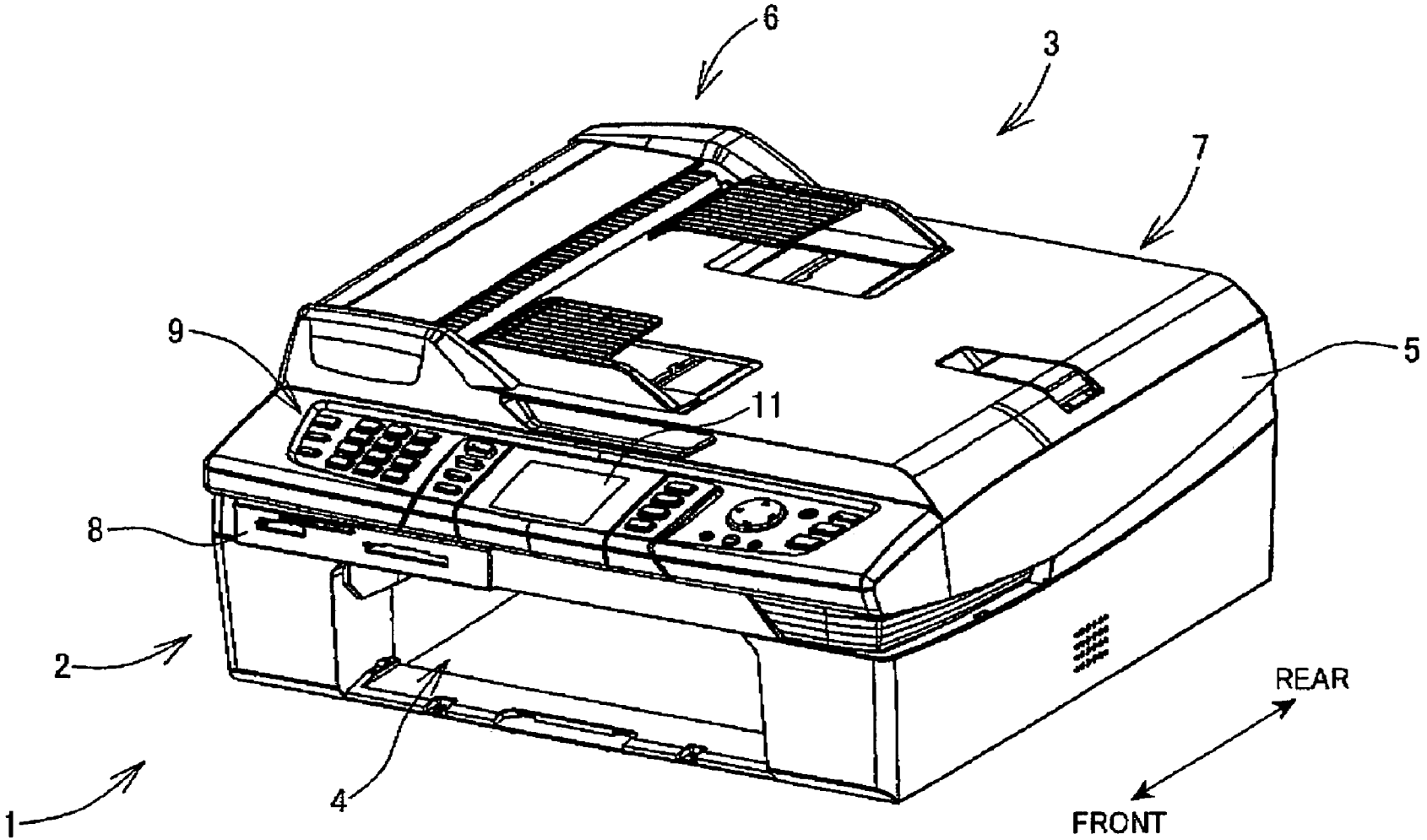
FIG. 3 is a perspective view showing the outer appearance of a multifunction device according to illustrative aspects of the invention.

FIG. 3 is a perspective view showing the outer appearance of a multifunction device 1, serving as the image recording apparatus according to the illustrative aspects. As shown in FIG. 3, the multifunction device 1 is integrally configured of a printing unit 2 disposed in the bottom of the multifunction device 1, a scanning unit 3 disposed in the top of the multifunction device 1, an original cover 7 provided on top of the scanning unit 3, a control panel 9 disposed on the front side and top surface of the multifunction device 1, and a slot section 8 disposed on the front surface of the multifunction device 1. The multifunction device 1 has a printer function, scanner function, copier function, facsimile function, and the like. However, the invention can be realized with any arbitrary combination of functions, such as a scanner function and facsimile function. Hence, the invention may be applied to a standalone printer having only a printer function.

The multifunction device 1 is primarily connected to a computer (not shown) and records images and text on recording paper in the printing unit 2 based on print data including image data and text data that is transferred from the computer. Further, by connecting a digital camera or other external device to the multifunction device 1, the multifunction device 1 can record image data outputted from the external device on recording paper. Similarly, by inserting a memory card or other storage medium in the multifunction device 1, the multifunction device 1 can record image data or the like stored in the storage medium onto recording paper. The multifunction device 1 has a single-sided printing function for recording images and text on only one side of the paper based on the print data, and a duplex printing function for recording both sides of the paper. The structure of the multifunction device 1 in the following description is merely one example of an image recording apparatus according to the invention, and it should be apparent that the structure can be appropriately modified within the scope of the invention.

The control panel 9 is provided on the top front surface of the scanning unit 3, which is also the top surface on the front side of the multifunction device 1, for enabling the user to operate the printing unit 2 and scanning unit 3. The control panel 9 is configured of various operating buttons, and a liquid crystal display unit 11. Hence, the user can operate the multifunction device 1 by inputting instructions via the control panel 9. The operating buttons may be configured of a Start button for initiating operations on the printing unit 2 and scanning unit 3; a Stop button for halting operations or canceling settings; a Mode Selection button for selecting the facsimile function, numerical buttons for inputting the number of copies, the scanning resolution of the scanning unit 3, and the like; a Setting button for setting either single-sided printing (one-sided copying) or duplex printing (double-sided copying); and other input keys. A controller operates the multifunction device 1 based on input from the control panel 9. Of course, when the multifunction device 1 is connected to a computer, as described above, the multifunction device 1 may be operated based on commands received from the computer via a printer driver or a scanner driver.

The slot section 8 is provided on the front surface of the multifunction device 1 near the left side thereof. Various small memory cards can be inserted into the slot section B. The multifunction device 1 reads image data stored on the memory cards inserted into the slot section 8 and displays data related to this image data on the liquid crystal display unit 11, enabling the user to print desired images on recording paper using the scanning unit 3. The user inputs a selection via the control panel 9.

As shown in FIG. 3, the scanning unit 3 includes an original scanning base 5 functioning as a flatbed scanner. The original cover 7 is attached to the original scanning base 5 via hinges (not shown) provided on the rear side surface so as to be capable of opening and closing via the hinges. The original scanning base 5 has a structure that is well known in the art, such as a structure having a contact glass disposed on the top surface, and an image-scanning unit disposed below the contact glass and housing a contact image sensor (CIS). The original cover 7 also includes an automatic document feeder (ADF) 6. When functioning as a flatbed scanner, the scanning unit 3 reads images from an original document placed on the contact glass by exposing and scanning the document as the image-scanning unit is moved under the contact glass. When reading an original image using the ADF 6, the original conveyed by the ADF 6 passes over a scanning surface of the contact glass while the image-scanning unit fixed in a position below the scanning surface reads images from the original. It should also be apparent that the invention may be applied to an image-scanning unit configured of an image sensor, such as a charge-coupled device (CCD) or a complementary metal oxide semiconductor (CMOS). Since the structure of the scanning unit 3 in the invention is arbitrary, a detailed description of the image-scanning unit will not be included in the present aspect.

Figure 4:
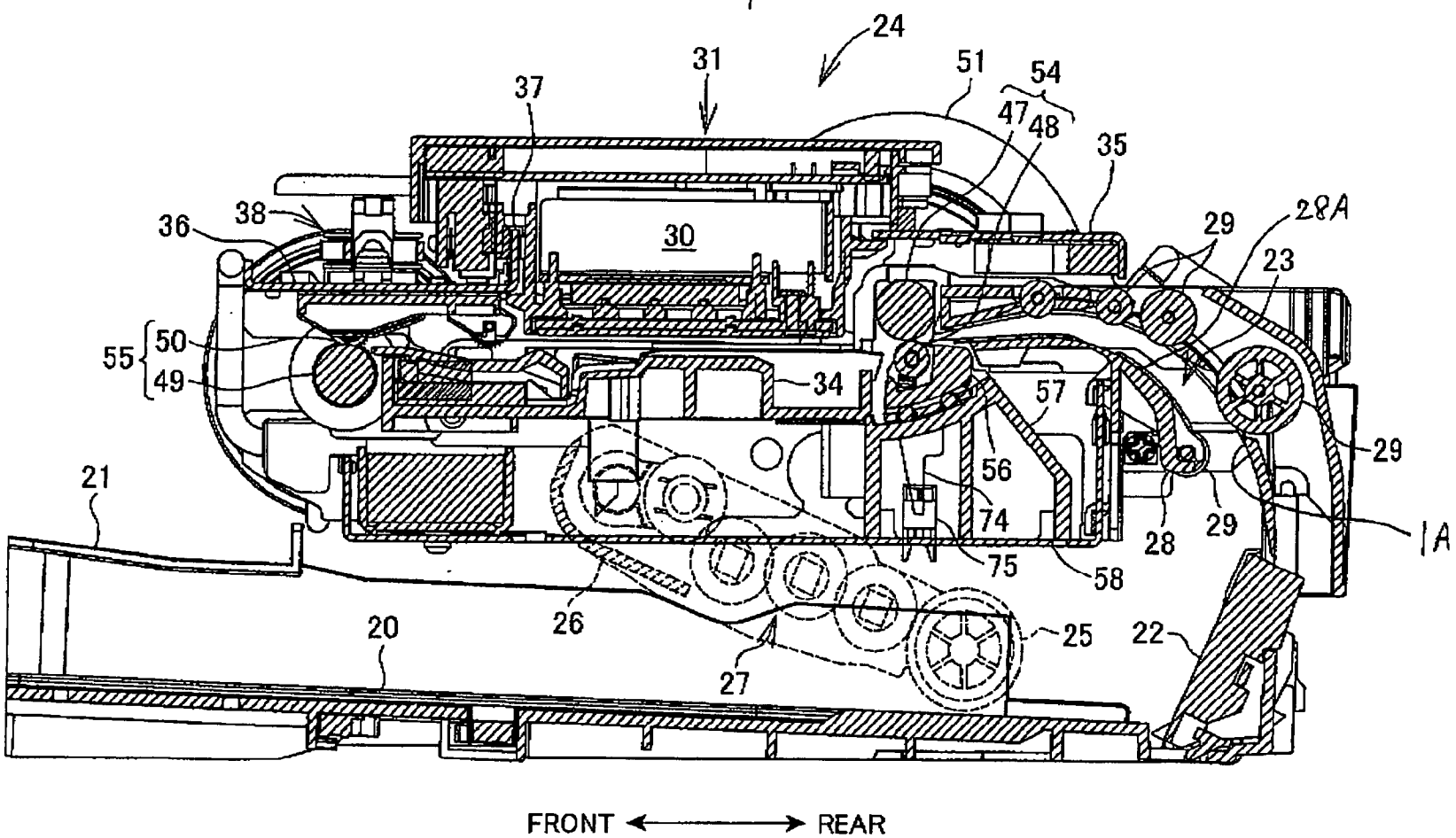
FIG. 4 is a side cross-sectional view of a printing unit provided in the multifunction device of FIG. 3.
Figure 5:
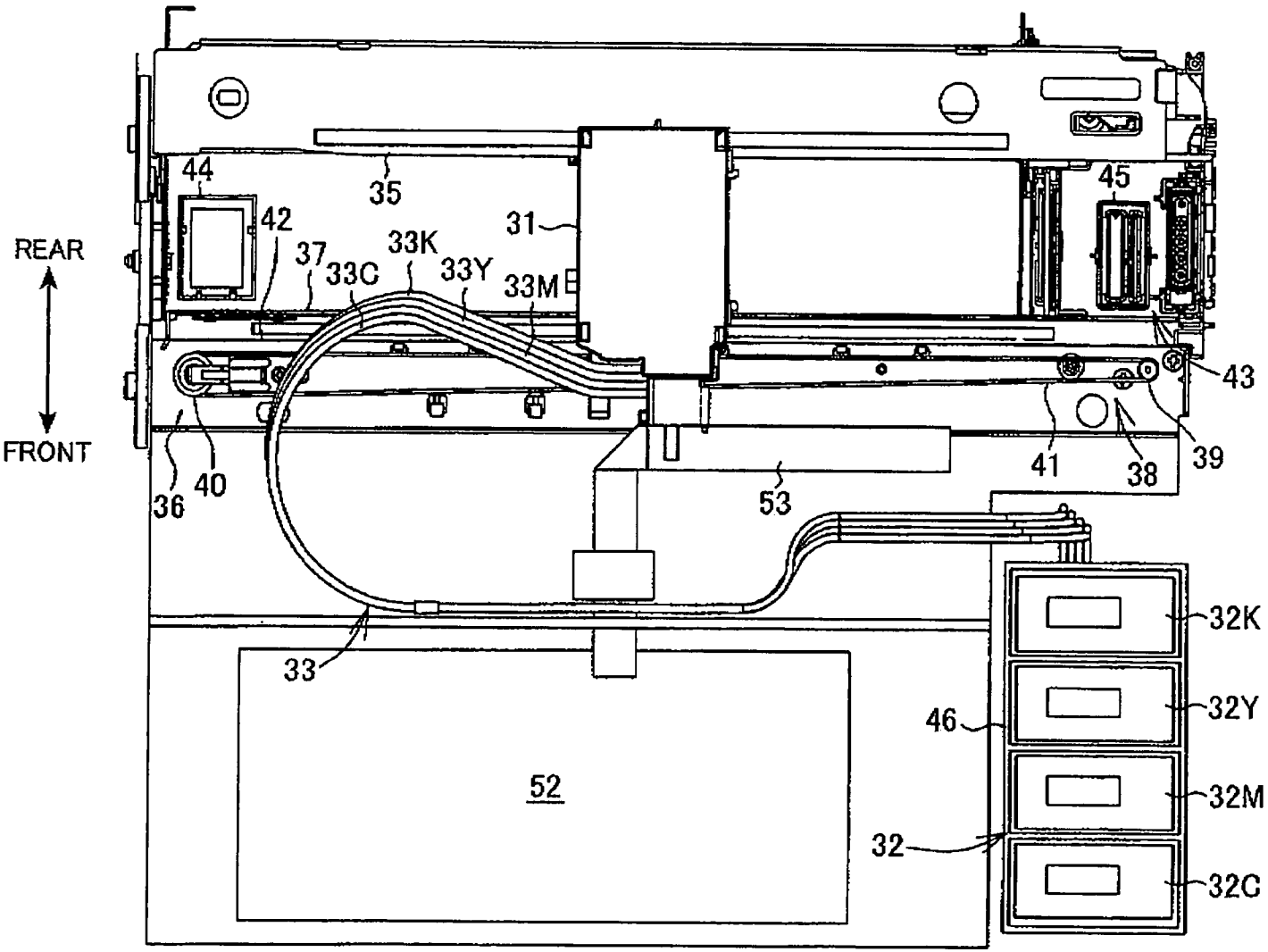
FIG. 5 is a plan view of the printing unit when a scanning unit has been removed.
Figure 6:
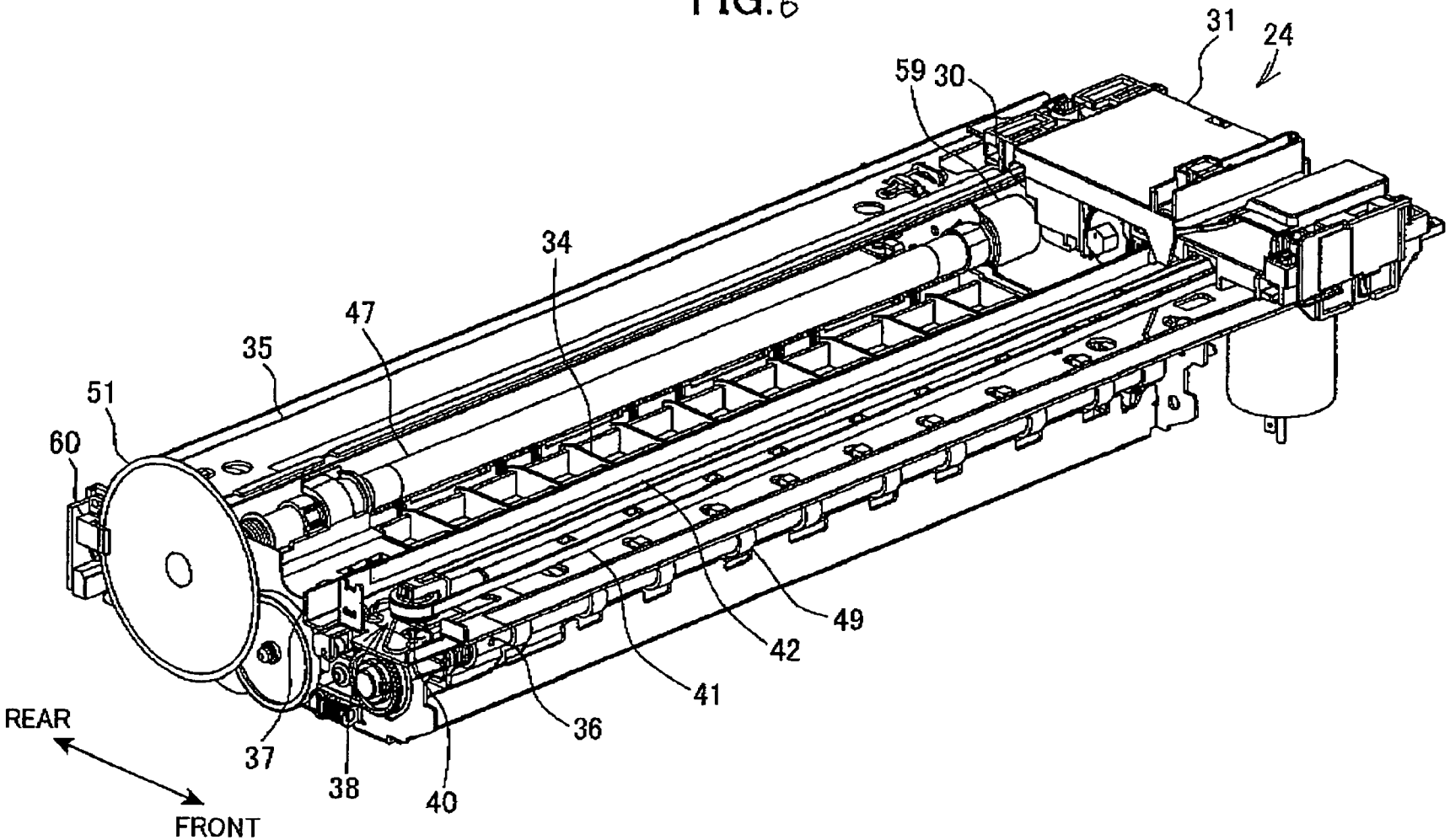
FIG. 6 is a perspective view illustrating the structure around an image-recording unit.
Figure 7:
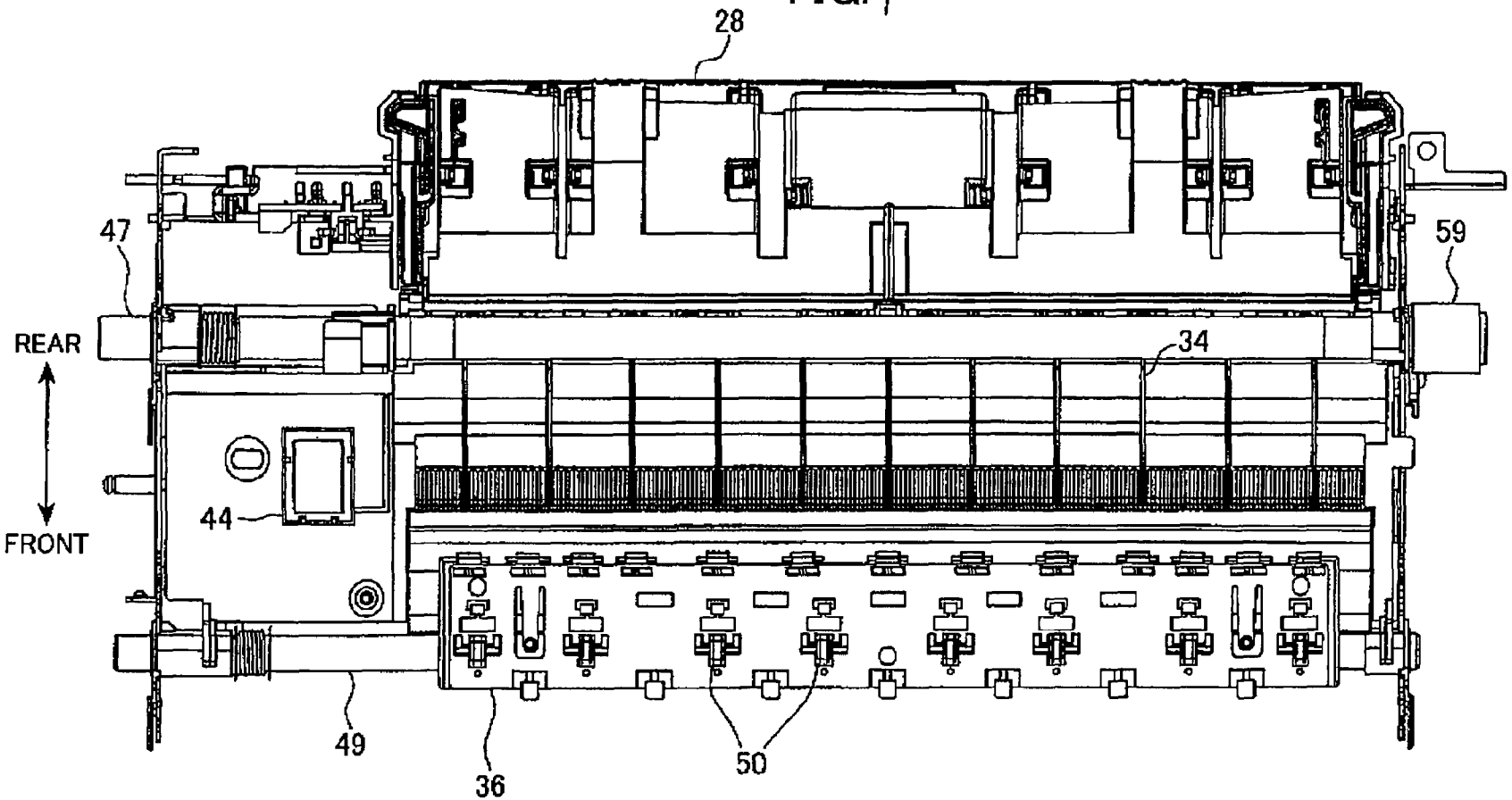
FIG. 7 is a plan view illustrating the structure around the image-recording unit.

Next, the structure of the printing unit 2 will be described in detail with reference to FIGS. 3 through 7. FIG. 4 is a side cross-sectional view of the printing unit 2 provided in the multifunction device 1. FIG. 5 is a plan view of the printing unit 2 when the scanning unit 3 has been removed. FIG. 6 is a perspective view illustrating the structure around an image recording unit described later. FIG. 7 is a plan view illustrating the structure around the image recording unit. For convenience, a recording head, belt driving mechanism, guide rail, and purging mechanism described later have been omitted from FIG. 7.

As shown in FIGS. 3 and 4, an opening 4 is formed in the front surface side of the printing unit 2. A paper tray 20 and a discharge tray 21 are mounted in the multifunction device 1 via the opening 4. The paper tray 20 and discharge tray 21 have been omitted from FIG. 3. The paper tray 20 can accommodate a recording paper of a desired size, such as the A4 size or the B5 size. As shown in FIG. 4, the longitudinal direction of paper accommodated in the paper tray 20 extends in the depth direction (the front-to-rear direction) of the multifunction device 1 when the paper tray 20 is mounted in the multifunction device 1. The discharge tray 21 is supported on the paper tray 20 and disposed thereabove. Hence, the paper tray 20 and discharge tray 21 are stacked in two vertical levels when mounted in the multifunction device 1. The recording paper may be normal paper, glossy paper, or the like and corresponds to the recording medium of the invention. A transparency or other non-paper medium also corresponds to the recording medium of the invention.

A separating sloped surface 22 is provided on the far side (rear side) of the paper tray 20 when the paper tray 20 is mounted in the multifunction device 1. The separating sloped surface 22 functions to separate paper fed from the paper tray 20 and to guide the paper upward.

A conveying path 23 is formed above the separating sloped surface 22. The conveying path 23 extends upward from the top side of the separating sloped surface 22 and curves toward the front surface side of the multifunction device 1. The conveying path 23 extends from the rear side of the multifunction device 1 to the front side, passing through the nip part of a conveying device 54 and below an image recording unit 24 described later and leads to the discharge tray 21. Hence, paper fed from the paper tray 20 is guided to the image recording unit 24 along a U-shaped path from the bottom to the top of the conveying path 23. After the image recording unit 24 records an image on the paper, the paper is discharged onto the discharge tray 21.

A feeding roller 25 is disposed above the paper tray 20. The feeding roller 25 is supported on the rear end of a feed arm 26. The feed arm 26 is capable of moving up and down so that the feeding roller 25 can contact or separate from the paper tray 20. A drive transmission mechanism 27 configured of a plurality of engaged gears transmits a driving force from a motor (not shown) to rotate the feeding roller 25. The feeding roller 25 functions to separate and feed paper stacked on the paper tray 20 to the conveying path 23 one sheet at a time. More specifically, the feeding roller 25 contacts the topmost sheet of recording paper stacked on the paper tray 20 with pressure. By rotating, the feeding roller 25 generates a frictional force between the roller surface of the feeding roller 25 and the recording paper that conveys the topmost sheet of paper to the separating sloped surface 22. The leading edge of the paper fed by the feeding roller 25 contacts the separating sloped surface 22 and is guided upward into the conveying path 23. If a sheet of paper below the topmost sheet is conveyed together with the topmost sheet due to frictional force or static electricity acting between the sheets, the sheet beneath the topmost sheet is halted when contacting the separating sloped surface 22 so that only the topmost sheet is conveyed.

Except for the region occupied by the image recording unit 24 and the like, the conveying path 23 is configured of an outer guide surface and an inner guide surface that confront each other over a predetermined distance. For example, the section of the conveying path 23 formed on the rear side of the multifunction device 1 has an outer guide surface 1A formed integrally with the frame of the multifunction device 1, and an inner guide surface 28A configured of a guide member 28 fixed to the inside of the frame. Conveying rollers 29 are provided at predetermined locations along the conveying path 23 and particularly along the curved region of the conveying path 23. The conveying rollers 29 are disposed so that the surfaces thereof are exposed from the outer guide surface 1A or inner guide surface 28A, and are capable of rotating about axes parallel to the width direction of the conveying path 23. The conveying rollers 29 enable the recording paper to be smoothly conveyed when contacting the guide surfaces 1A and 28A in the curved region of the conveying path 23.

The image recording unit 24 includes a carriage 31 that reciprocates in a main scanning direction (a direction orthogonal to the surface of the drawing in FIG. 4). A recording head 30 is mounted in the carriage 31. Ink in the colors cyan (C), magenta (M), yellow (Y), and black (Bk) is supplied to the recording head 30 from ink tanks 32 via ink tubes 33 (see FIG. 5). The recording head 30 ejects ink of each color as microdroplets through nozzles formed in the bottom surface thereof. The recording head 30 records images on a recording paper conveyed over a platen 34 as the carriage 31 reciprocates in the main scanning direction to scan the recording head 30 over the recording paper.

As shown in FIGS. 5 and 6, a pair of guide rails 35 and 36 is provided on the image recording unit 24 above the conveying path 23. The guide rails 35 and 36 extend in the width direction of the conveying path 23 and are separated from each other in the conveying direction of the recording paper. The carriage 31 is disposed so as to straddle the guide rails 35 and 36 and is capable of sliding over the guide rails 35 and 36 in the width direction of the conveying path 23. The guide rail 35 is disposed on the upstream side in the paper-conveying direction (the rear side) and has a plate shape that is longer in the width direction of the conveying path 23 than the scanning range of the carriage 31. The top surface of the guide rail 35 slidably supports the upstream end of the carriage 31.

The guide rail 36 disposed on the downstream side in the paper-conveying direction (the front side) is plate-shaped and has a length in the width direction of the conveying path 23 that is substantially the same as the guide rail 35. The top surface of the guide rail 36 is bent at substantially a right angle to form an end part 37 angled upward on the upstream side of the guide rail 36 in the paper-conveying direction. An engaging member (not shown) is provided on the carriage 31 for engaging with the end part 37 of the guide rail 36 by gripping both sides of the end part 37. In this way, the carriage 31 is slidably supported on the guide rails 35 and 36 and is capable of reciprocating in the width direction of the conveying path 23 along the end part 37 of the guide rail 36. A pair of rollers or the like may also be used in place of the engaging member for gripping the end part 37. Further, sliding members may also be provided on portions of the surfaces of the guide rails 35 and 36 contacted by the carriage 31 to reduce friction.

A belt-driving mechanism 38 is provided on the top surface of the guide rail 36. The belt-driving mechanism 38 includes a drive pulley 39 and a follow pulley 40 disposed near both widthwise ends of the conveying path 23, and an endless timing belt 41 disposed around the drive pulley 39 and follow pulley 40. The timing belt 41 has teeth formed on the inner side surface thereof. A motor (not shown) is coupled to the shaft of the drive pulley 39 for inputting a driving force into the shaft of the drive pulley 39. When the drive pulley 39 rotates, the timing belt 41 moves in a circuitous motion. The timing belt 41 may also be configured of a belt having ends, both of which ends are fixed to the carriage 31.

The carriage 31 is fixed to the timing belt 41. By moving the timing belt 41 circuitously, the carriage 31 reciprocates over the guide rails 35 and 36 in a position based on the end part 37. Since the recording head 30 is mounted in the carriage 31, the recording head 30 also reciprocates together with the carriage 31 along the width direction of the conveying path 23, which is the main scanning direction. An encoder strip 42 of a linear encoder is provided on the guide rail 36 along the end part 37. The linear encoder detects the encoder strip 42 with a photointerrupter, and a controller (not shown) controls the reciprocating motion of the carriage 31 based on detection signals from the linear encoder.

As shown in FIGS. 4, 6, and 7, the platen 34 is disposed on the bottom of the conveying path 23 in confrontation with the recording head 30, The platen 34 extends over the center region within the reciprocating range of the carriage 31 through which the recording paper passes. The width of the platen 34 is sufficiently larger than the maximum width of recording paper that can be conveyed in the multifunction device 1 so that both edges of the paper pass over the platen 34.

As shown in FIG. 5, a purging mechanism 43 and a waste ink tray 44 are disposed outside the image recording range of the recording head 30 and, more specifically, in regions on both sides of the platen 34 through which the recording paper does not pass. The purging mechanism 43 functions to draw out air bubbles and foreign matter along with ink from nozzles and the like formed in the recording head 30. The purging mechanism 43 includes a cap 45 for covering the nozzle surface of the recording head 30. A pump mechanism is connected to the cap 45. A moving mechanism is also provided for moving the cap 45 to contact or separate from the nozzle surface of the recording head 30. When an operation is performed to remove air bubbles and the like from the recording head 30, the carriage 31 is moved so that the recording head 30 is positioned above the cap 45. Subsequently, the moving mechanism moves the cap 45 upward to form a hermetic seal over the nozzles formed in the bottom surface of the recording head 30. The pump mechanism coupled to the cap 45 then draws out ink from the nozzles.

The waste ink tray 44 is disposed on the opposite side from the purging mechanism 43 in the width direction in a position outside the image-forming range of the carriage 31. The waste ink tray 44 receives ink that has been flushed out of the recording head 30 (this operation is called "flushing"). The purging mechanism 43 and waste ink tray 44 constitute a maintenance unit that can perform such maintenance as removing air bubbles and mixed ink of different colors from the recording head 30.

As shown in FIG. 5, the ink tanks 32 are accommodated in an ink tank accommodating section 46 disposed in the front right side of the printing unit 2. The ink tanks 32 are provided separately from the carriage 31 and recording head 30 in the printing unit 2. The ink tanks 32 include four ink tanks 32C, 32M, 32Y, and 32K accommodating ink of the respective colors cyan (C), magenta (M), yellow (Y), and black (Bk). The ink tanks 32 supply ink to the carriage 31 via the ink tubes 33.

Ink from the ink tanks 32C, 32M, 32Y, and 32K accommodated in the ink tank accommodating section 46 is supplied through the ink tubes 33, which are provided independently for each color. The ink tubes 33 are tubes formed of synthetic resin and are flexible so as to be able to bend when the carriage 31 moves in a scanning motion. Openings formed at one end of the ink tubes 33 are connected to respective joints provided at ink tank accommodating positions in the ink tank accommodating section 46, The ink tube 33C corresponds to the ink tank 32C and supplies cyan ink therefrom. Similarly, the ink tubes 33M, 33Y, and 33K correspond to the ink tanks 32M, 32Y, and 32K and supply the corresponding ink colors magenta, yellow, and black therefrom.

From the ink tank accommodating section 46, the ink tubes 33 are led along the width direction of the multifunction device 1 to a position near the center thereof, at which position the ink tubes 33 are fixed to an appropriate member on the device frame or the like. The section of the ink tubes 33 from the fixed part to the carriage 31 is a U-shaped curved portion that is not fixed to the device frame or the like and that changes in shape as the carriage 31 reciprocates. Hence, as the carriage 31 moves toward one end (the left side in FIG. 5) in the reciprocating direction, the ink tubes 33 move in the same direction as the carriage 31 while flexing so that a curved radius of the U-shaped curved portion grows smaller. When the carriage 31 moves to the other end (the right side in FIG. 5) in the reciprocating direction, the ink tubes 33 move in the same direction while flexing so that the curved radius of the U-shaped curved portion grows larger.

Figure 14:
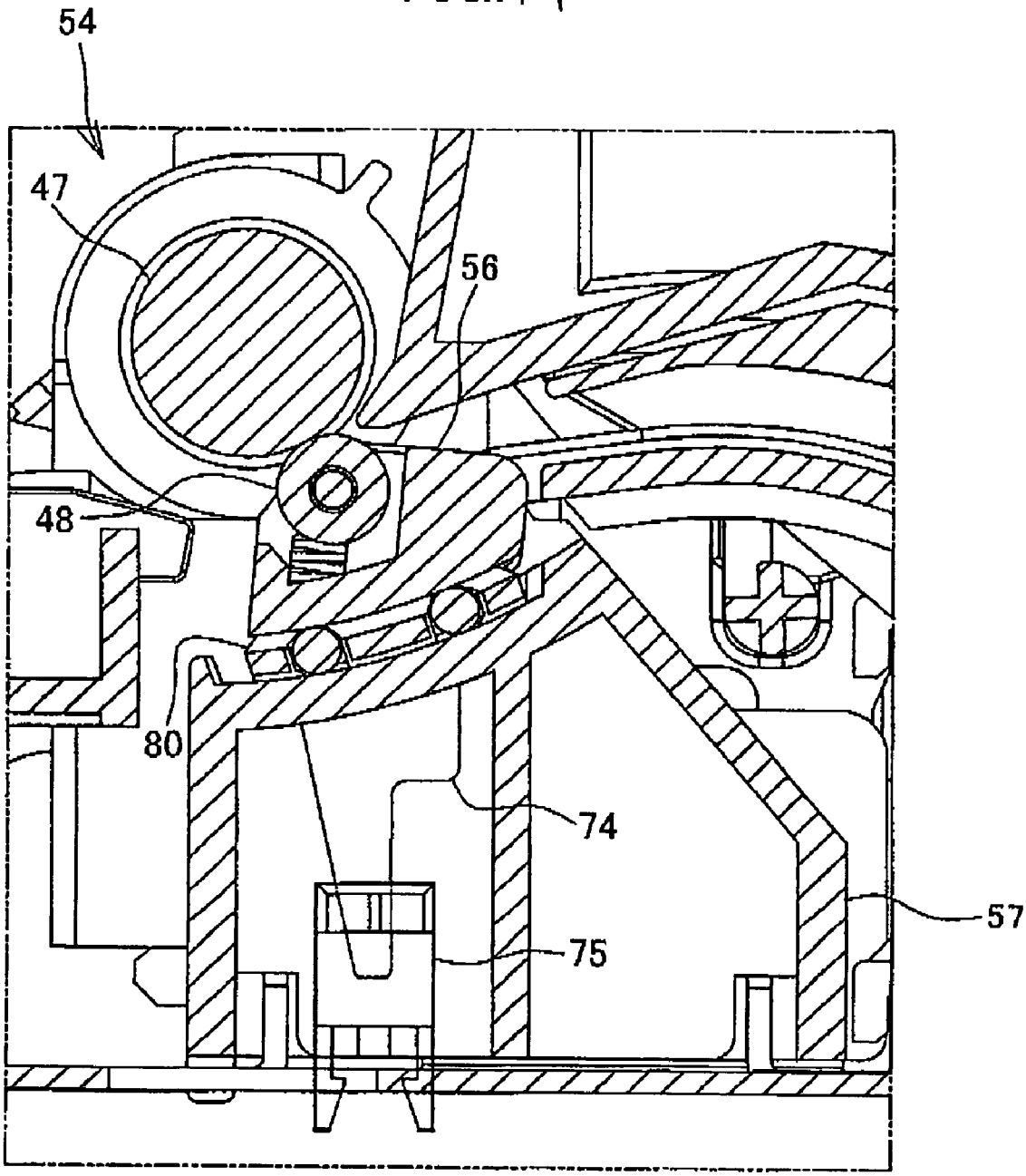
FIG. 14 is a partial cross-sectional view showing the state of the pinch roller holder in a retracted position.
Figure 15:
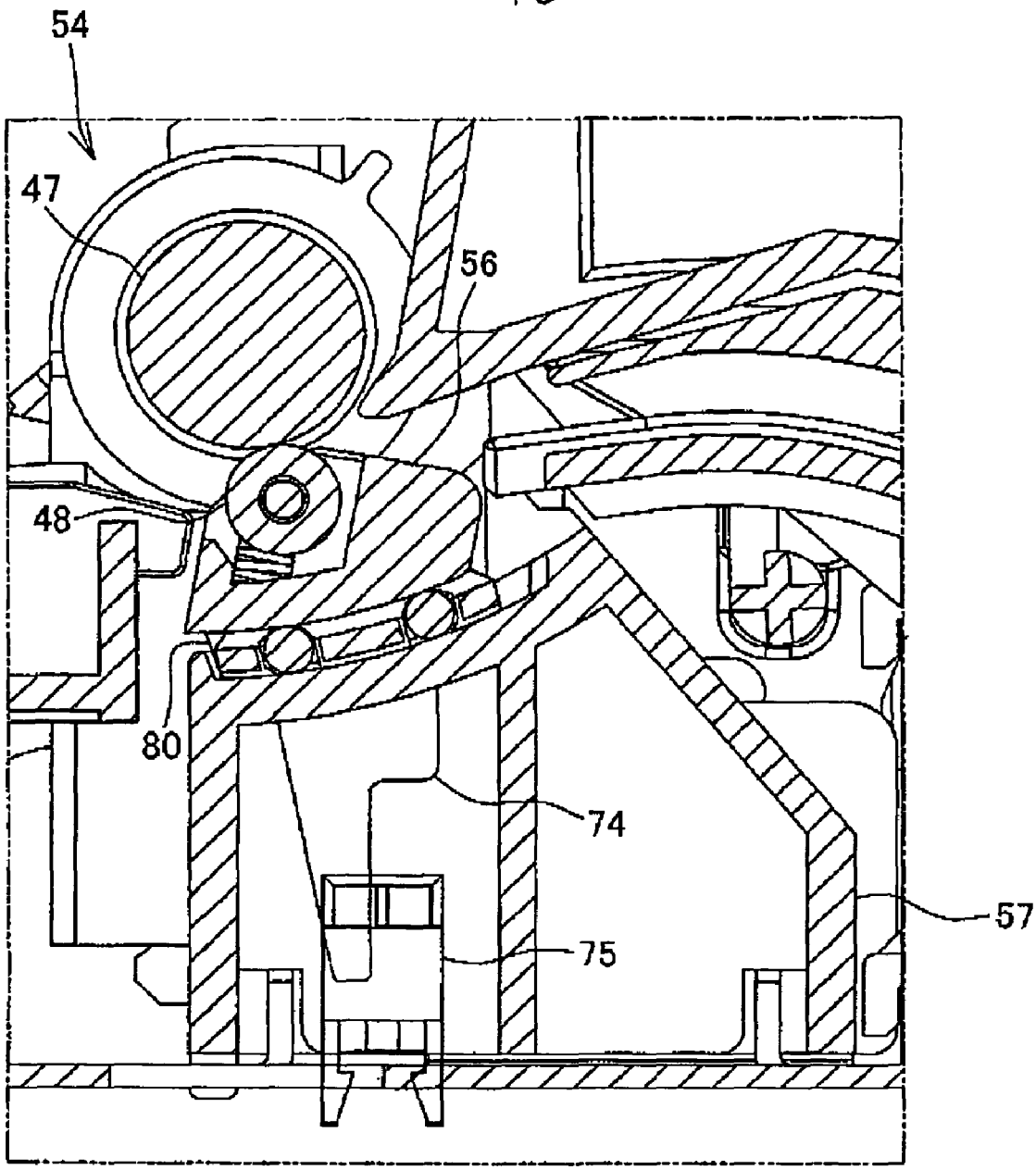
FIG. 15 is a partial cross-sectional view showing the state of the pinch roller holder in a conveying position.

As shown in FIGS. 4, 6, and 7, a pair of conveying rollers 54 having a drive roller 47 and pinch rollers 48 disposed below the drive roller 47 is provided on the upstream side of the image recording unit 24. The drive roller 47 and pinch rollers 48 pinch a recording paper conveyed along the conveying path 23 and convey the recording paper over the platen 34. Springs 61 (see FIG. 8) apply a predetermined urging force to the pinch rollers 48 to press the pinch rollers 48 against the drive roller 47. The pinch rollers 48 are rotatably supported in a pinch roller holder 56 with the springs 61 in a compressed state. A detection member 74 described later is provided on the pinch roller holder 56. The pinch roller holder 56 is supported by a holder support member 57 provided on an internal frame 58 constituting part of the casing in the multifunction device 1 so as to be capable of rolling in the conveying direction of the paper. With this construction, the pinch roller holder 56 rollingly moves to a conveying position on the downstream side, shown in FIG. 15, when the conveying rollers 54 are conveying the recording paper and rollingly moves to a retracted position on the upstream side, shown in FIG. 14, when the trailing edge of the recording paper leaves the conveying rollers 54. As shown in FIGS. 14 and 15, the detection member 74 moves along with movement of the pinch roller holder 56. A detailed description of the structures of the holder support member 57 and pinch roller holder 56 and the supporting structure for supporting the pinch roller holder 56 on the holder support member 57 is given below. The pinch rollers 48, springs 61, pinch roller holder 56, holder support member 57, and restricting part 75 are one example of components constituting the sheet detecting device of the invention.

A photointerrupter 75 is disposed below the holder support member 57 in substantially the longitudinal center thereof. The photointerrupter 75 is attached to the internal frame 58 in a position covered by the holder support member 57. The photointerrupter 75 is a photocoupler integrally provided with a light-emitting element for emitting light and a light-receiving element for receiving the light emitted from the light-emitting element. A slit (not shown) is formed in the photointerrupter 75 for allowing the detection member 74 to pass between the light-emitting element and light-receiving element. There is no particular restriction on the position of the photointerrupter 75, provided that the detection member 74 can pass between the light-emitting element and light-receiving element. The photointerrupter 75 may be disposed on the holder support member 57, for example, to simplify the assembly process.

The photointerrupter 75 is connected by signal lines to a control circuit board 52 described later. The control circuit board 52 monitors an electric signal (voltage or current, for example) generated in the light-receiving element based on the amount of light received. The control circuit board 52 determines that the photointerrupter 75 is on or off based on the intensity of the electric signal. For example, the control circuit board 52 determines that the photointerrupter 75 is on when a voltage signal greater than a predetermined threshold is produced in the light-receiving element, and determines that the photointerrupter 75 is off when the voltage signal is less than the threshold value. An on determination signifies paper is detected, while an off determination signifies paper is not detected. In the illustrative aspects, the invention is applied to the photointerrupter 75 as one example of the detecting unit. However, the invention may be applied to an electric sensor or the like in place of an optical sensor, such as the photointerrupter 75, for detecting the detection member 74 based on fluctuations in electric resistance or in a magnetic field or electric field, for example.

A pair of discharge rollers 55 is provided on the downstream side of the image recording unit 24 and includes a drive roller 49, and spur rollers 50 disposed above the drive roller 49. The drive roller 49 and spur rollers 50 grip and convey the recording paper after an image has been recorded thereon. The surfaces of the spur rollers 50 are formed irregularly in a spur-like configuration so as not to degrade the image recorded on the paper.

As shown in FIGS. 6 and 7, a motor 59 is coupled to one axial end of the drive roller 47. A driving force transmitted from the motor 59 drives the drive rollers 47 and 49 to rotate intermittently at predetermined linefeed widths. The drive roller 47 and drive roller 49 rotate in synchronization. As shown in FIG. 6, a rotary encoder includes an encoder disc 51 provided on the drive roller 47, and a photointerrupter 60 for detecting the encoder disc 51. The rotations of the drive rollers 47 and 49 are detected based on detection signals from the rotary encoder.

Hence, paper interposed between the drive roller 47 and pinch roller 48 is conveyed intermittently over the platen 34 at predetermined linefeed widths. The recording head 30 scans the paper after each linefeed to record an image beginning from the leading edge side of the paper. After an image has been recorded on the paper, the leading edge side becomes interposed between the drive roller 49 and spur rollers 50. At this time, the paper is conveyed intermittently at the predetermined linefeed widths, while the leading edge side of the paper is interposed between the drive roller 49 and spur rollers 50, and the trailing edge side is interposed between the drive roller 47 and pinch roller 48, during which time the recording head 30 continues recording an image on the paper. After the paper is conveyed farther, the trailing edge of the paper passes through and separates from the drive roller 47 and pinch roller 48. Hence, the paper is conveyed intermittently at the predetermined linefeed widths while interposed only between the drive roller 49 and spur rollers 50 as the recording head 30 continues to record an image after each linefeed. When the trailing edge of the recording paper comes out of the drive roller 47 and pinch roller 48, the pinch roller holder 56 simultaneously rolls to the retracted position downstream, shown in FIG. 14. After the recording head 30 has completed recording an image in the predetermined region of the paper, the drive roller 49 is driven to rotate continuously so that the paper interposed between the drive roller 49 and spur rollers 50 is discharged onto the discharge tray 21.

As shown in FIG. 5, the control circuit board 52 is disposed on the front surface side of the multifunction device 1. Recording signals are transmitted from the control circuit board 52 to the recording head 30 via a flat cable 53. The flat cable 53 is an insulated ribbon cable configured of conductors for transmitting electric signals coated in a synthetic resin film, such as a polyester film. The flat cable 53 electrically connects the control circuit board 52 to a control circuit board (not shown) in the recording head 30. The flat cable 53 extends in the reciprocating direction from the carriage 31 and is folded back to form substantially a U-shaped portion. The U-shaped portion is not fixed to any other member and changes in shape as the carriage 31 reciprocates.

Figure 8:
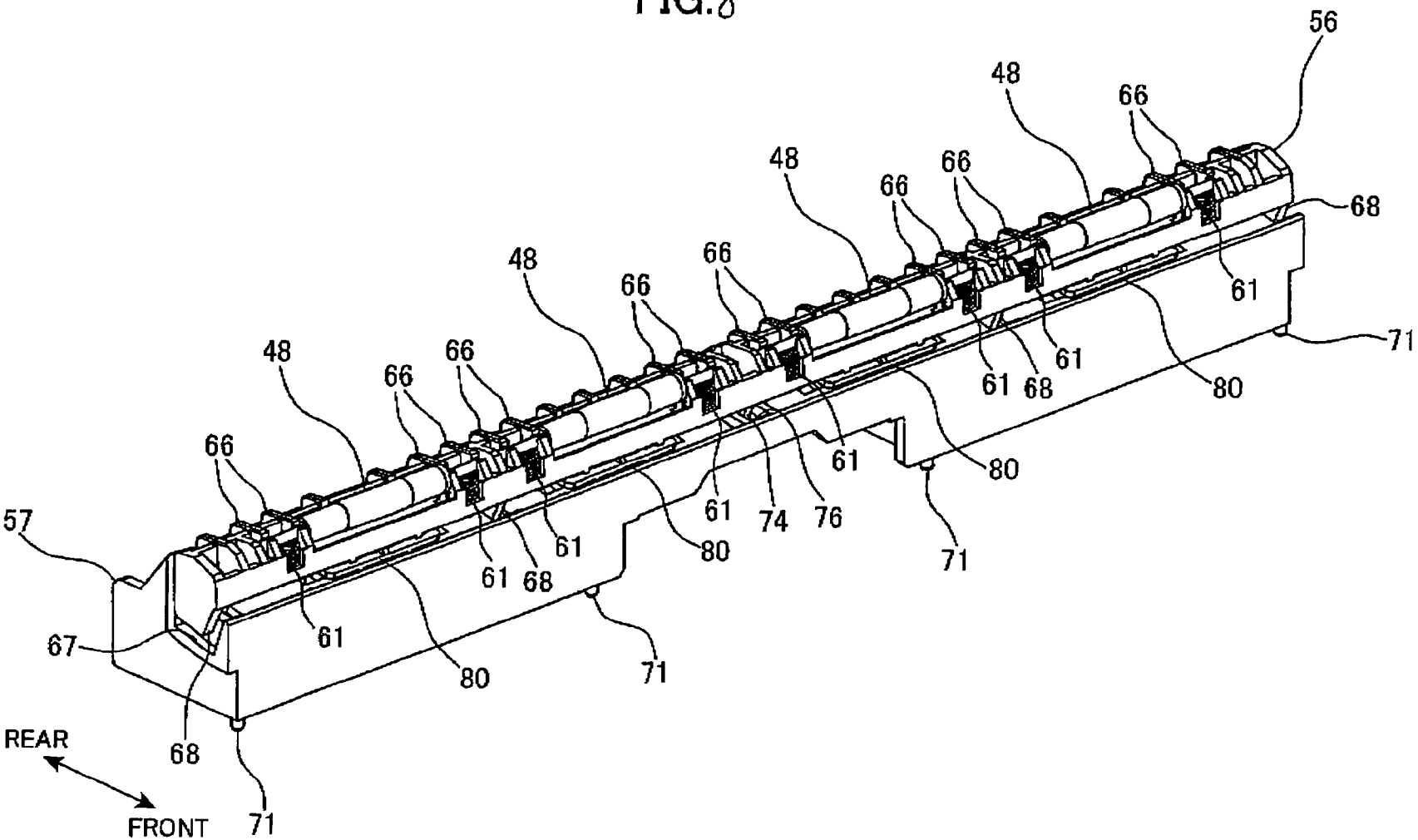
FIG. 8 is a perspective view showing the state of a pinch roller holder supported on a holder support member.
Figure 9:
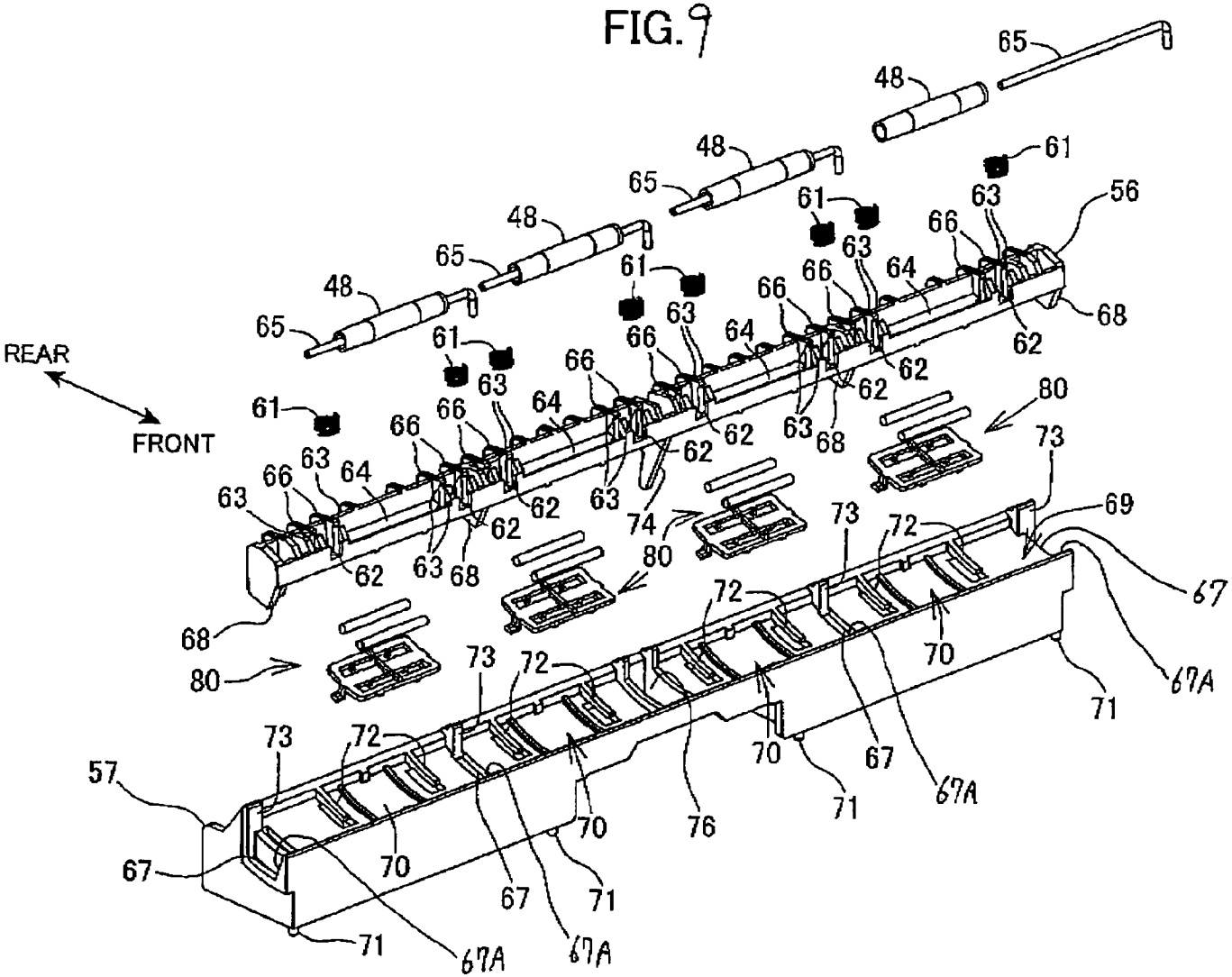
FIG. 9 is an exploded view of the holder support member and pinch roller holder.
Figure 10:
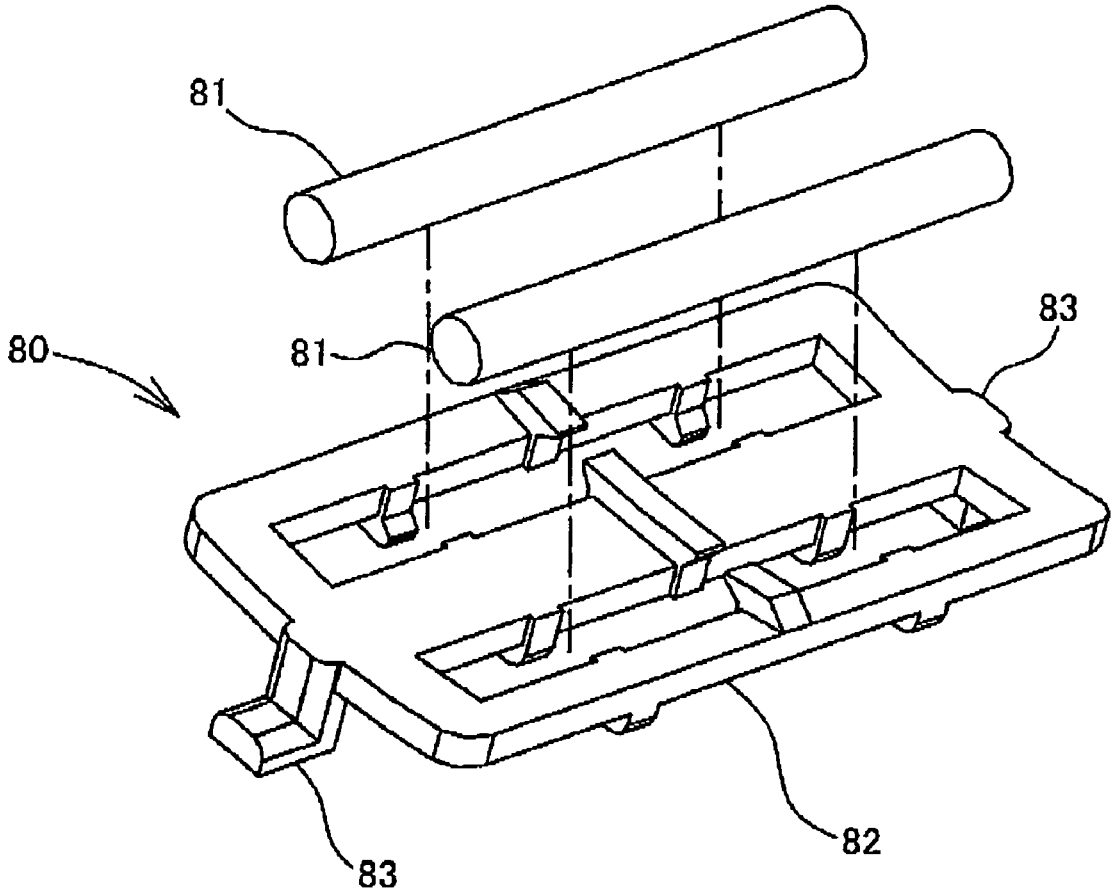
FIG. 10 is a perspective view showing the structure of a rolling bearing.
Figure 11:
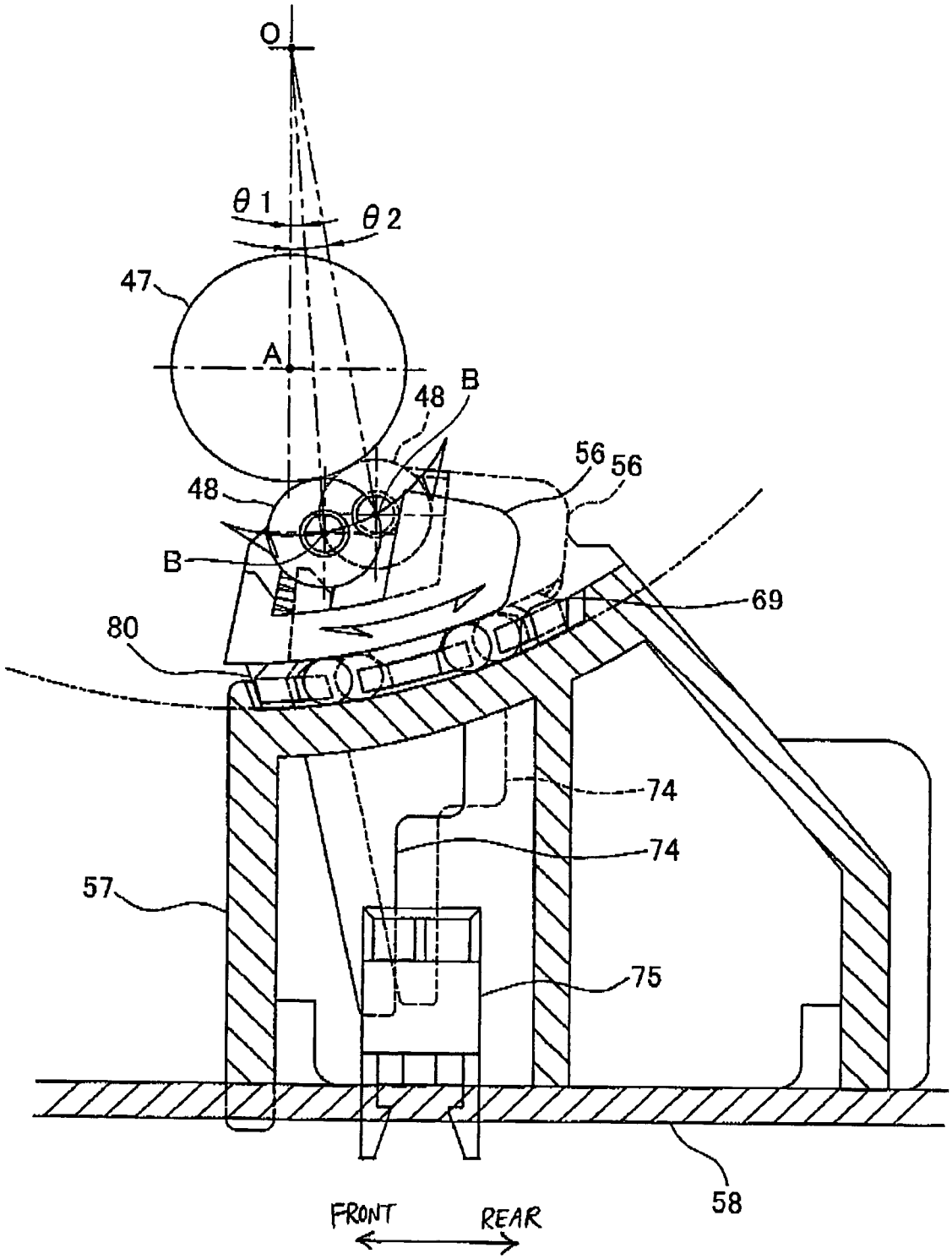
FIG. 11 is an enlarged view illustrating the moving range of the pinch roller holder.

Next, the structures of the holder support member 57 and pinch roller holder 56 will be described in detail with reference to FIGS. 8 through 11, FIG. 8 is a perspective view showing the state of the pinch roller holder 56 supported on the holder support member 57. FIG. 9 is an exploded view of the holder support member 57 and pinch roller holder 56. FIG. 10 is a perspective view showing the structure of a roller bearing 80. FIG. 11 is an explanatory diagram illustrating a detection state and non-detection state of the detection member 74.

As shown in FIGS. 8 and 9, the pinch roller holder 56 has an elongated shape and is oriented so that the longitudinal direction matches the width direction of the recording paper. Four roller-accommodating compartments 64, and eight spring-accommodating compartments 62 are provided on the top surface of the pinch roller holder 56 confronting the drive roller 47. The roller-accommodating compartments 64 are formed at predetermined intervals along the longitudinal direction of the pinch roller holder 56. The spring-accommodating compartments 62 are formed adjacent to and on both ends of the roller-accommodating compartments 64. The pinch rollers 48 are accommodated in the roller-accommodating compartments 64 and have rotational shafts 65 aligned with the longitudinal direction of the pinch roller holder 56. The springs 61 are accommodated in the spring-accommodating compartments 62 in a compressed state. This structure is one example, but it should be apparent that the number of pinch rollers 48 and springs 61 and the accommodating method may be modified as appropriate. The springs 61 are not limited to the coil springs shown in the drawings.

The spring-accommodating compartments 62 are defined by partitioning plates 66 erected on both longitudinal sides of the spring-accommodating compartments 62. A bearing 63 is formed in each partitioning plate 66 for supporting the rotational shaft 65 of the respective pinch roller 48. The bearings 63 are formed as long vertical grooves in the partitioning plates 66. The upper ends of the bearings 63 are formed slightly smaller than the diameter of the rotational shafts 65. When the rotational shafts 65 are pressed into the bearings 63, the upper ends of the grooves elastically expand so that the bearings 63 can receive the rotational shafts 65. The upper ends of the grooves return to their original shape after the rotational shafts 65 are completely inserted, preventing the rotational shafts 65 from easily coming out of the bearings 63. With this construction, the bearings 63 support the rotational shafts 65 so that the rotational shafts 65 can move vertically.

By housing the springs 61 in the spring-accommodating compartments 62 and inserting the rotational shafts 65 of the pinch rollers 48 into the bearings 63, the springs 61 are mounted in the spring-accommodating compartments 62 in a compressed state. The elastic force of the compressed springs 61 urges the pinch rollers 48 upward. In other words, an urging force toward the drive roller 47 is applied is to the pinch rollers 48. Hence, the pinch rollers 48 are urged by the springs 61 and rotatably supported by the bearings 63. Accordingly, when a thick sheet of recording paper is conveyed through the multifunction device 1, the paper pushes the pinch rollers 48 downward against the urging force of the springs 61 by a distance corresponding to the paper thickness.

Four protruding pieces 68 are formed on the bottom surface of the pinch roller holder 56. The protruding pieces 68 are designed to engage with four engaging grooves 67 (see FIG. 9) formed in the holder support member 57. The protruding pieces 68 are provided at both ends of the pinch roller holder 56 in the longitudinal direction. The protruding pieces 68 are also provided at positions separated from each of the both ends toward the longitudinal center position by the length of one pinch roller 48. The protruding pieces 68 are plate-shaped members protruding downward from the bottom surface of the pinch roller holder 56 and extend along the short dimension of the pinch roller holder 56. By inserting the protruding pieces 68 into the engaging grooves 67, the protruding pieces 68 fit into the engaging grooves 67 with a predetermined amount of play. With this construction, the pinch roller holder 56 is supported on the holder support member 57 so as to be capable of moving in the short dimension of the holder support member 57, that is, in the conveying direction of the recording paper, while the amount of movement is restricted to a predetermined range.

The detection member 74 is disposed on the bottom surface of the pinch roller holder 56 and in the approximate center thereof. The detection member 74 is inserted through a through-hole 76 (see FIG. 9) formed in the holder support member 57. The detection member 74 is a plate-shaped member that protrudes downward from the bottom surface of the pinch roller holder 56, A distal end of the detection member 74 enters or recedes from the optical path between the light-emitting emitting element and light-receiving element of the photointerrupter 75. Hence, the detection member 74 is formed at a length sufficient to reach the optical path of the photointerrupter 75. The positioning and shape of the detection member 74 may be modified as appropriate in accordance with the positioning of the photointerrupter 75 and the like.

Figure 12:
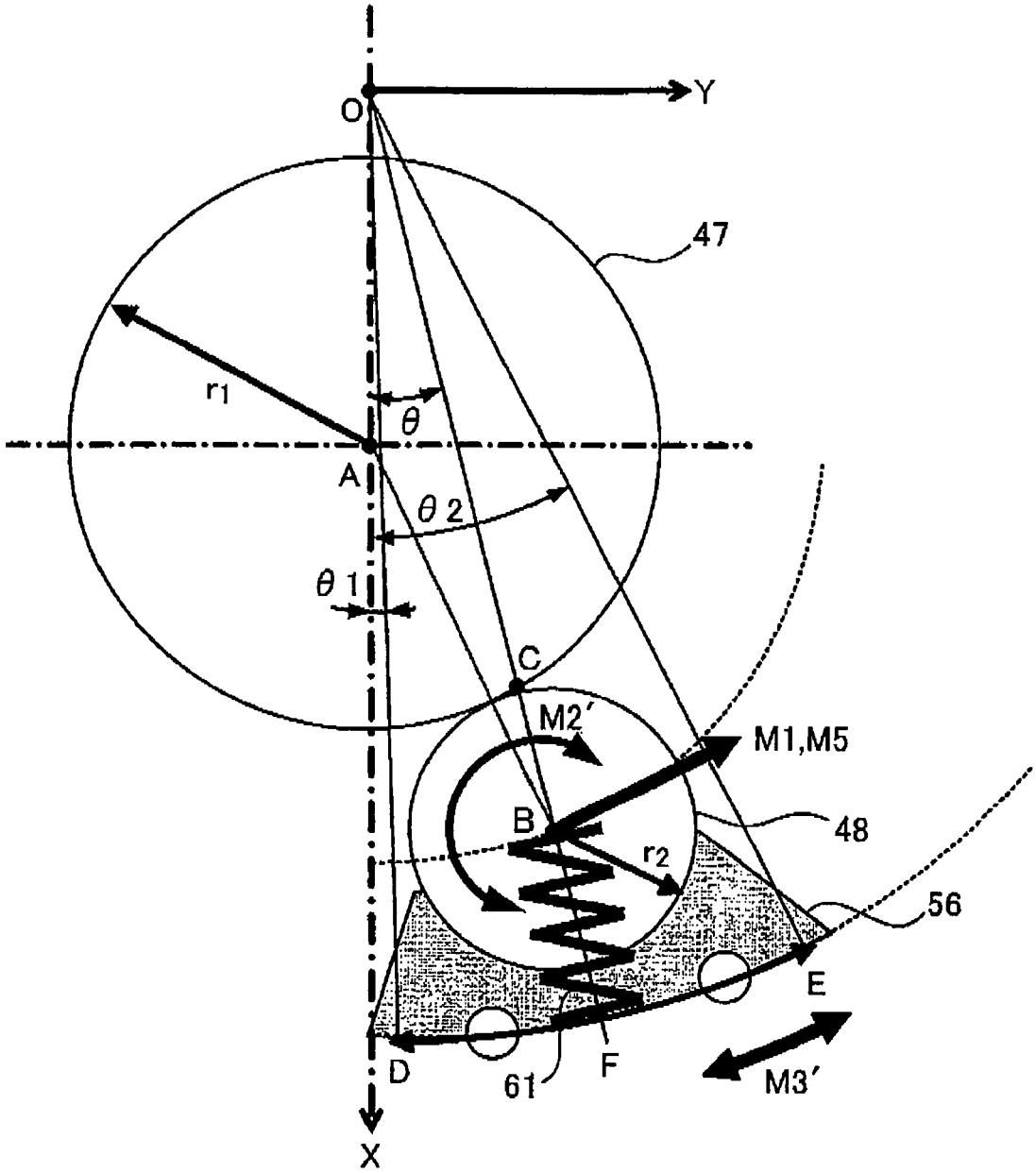
FIG. 12 is an explanatory diagram illustrating a cross section of a drive roller and pinch roller in an XY coordinate system having a center of revolution O as the point of origin.

The holder support member 57 is formed in an elongated shape similar to the pinch roller holder 56 and is disposed on the internal frame 58 so that the longitudinal dimension of the holder support member 57 matches the width dimension of the recording paper. More specifically, as shown in FIG. 5, the holder support member 57 is positioned on the internal frame 58 by fitting protrusions 71 formed on the bottom surface of the holder support member 57 into holes (not shown) formed in the internal frame 58. As shown in FIG. 12, a curved surface 69 (supporting surface) is formed on the top surface of the holder support member 57. The top surface 69 supports the bottom surface (support part) of the pinch roller holder 56 via roller bearings 80 interposed therebetween.

As shown in FIG. 11, the top surface 69 of the holder support member 57 slopes downward from the upstream side to the downstream side in the conveying direction. The top surface 69 has an arc shape that substantially conforms to the outer periphery of a cylindrical path about the center of revolution O, where the center of revolution O is parallel to a rotational center A of the drive roller 47 and exists in a vertical plane passing through the rotational center A. Hence, the pinch roller holder 56 moves along a path about the center of revolution O by rolling over the top surface 69. Since the springs 61 urge the pinch rollers 48 at this time, the pinch rollers 48 move over the peripheral surface of the drive roller 47 while constantly pressing against the drive roller 47. The center of revolution O does not necessarily have to exist in a vertical plane passing through the rotational center A, provided that the center of revolution O is positioned so that the distance between the center of revolution O and the curved top surface 69 is greater than the distance between the rotational center B and the curved top surface 69 of the holder support member 57.

As shown in FIGS. 9 and 10, the roller bearing 80 is configured of two rollers 81 juxtaposed in parallel along the short dimension of the holder support member 57, and a roller support member 82 for rotatably supporting the two rollers 81 together. The roller support member 82 is mounted on the top surface 69 of the holder support member 57 with the rollers 81 supported therein. Specifically, engaging pawls 83 having a substantially L-shaped cross section are formed one on each longitudinal end of the roller support member 82. The roller bearing 80 is mounted by engaging the engaging pawls 83 in engagement parts 72 formed in the top surface 69. As shown in the drawings, four of the roller bearings 80 are mounted at predetermined intervals along the longitudinal direction of the holder support member 57. By interposing roller bearings 80 having this structure between the pinch roller holder 56 and the top surface 69 of the holder support member 57, the pinch roller holder 56 is rollingly supported on the top surface 69. However, while the illustrative aspects give one example of using the roller bearings 80 as a support structure for rollingly supporting the pinch roller holder 56, it is possible to employ another structure that integrally provides freely rotatably rotary members on the top surface 69 of the holder support member 57 or the bottom surface of the pinch roller holder 56. For example, it is conceivable to incorporate roller bearings or ball bearings well known in the art in the top surface 69 or the bottom surface of the pinch roller holder 56. Instead of employing rotary bodies such as the rollers 81, it is possible to vary the structure so that the pinch roller holder 56 slidingly moves over the holder support member 57, for example.

Four of the engaging grooves 67 are formed in the top surface 69 of the holder support member 57 for engaging with the protruding pieces 68 described above. The engaging grooves 67 are formed sufficiently longer in the short dimension of the pinch roller holder 56 than the length of the protruding pieces 68 in the same direction. Ribs 73 extending upward from the top surface 69 of the holder support member 57 are formed on the rear ends of the engaging grooves 67, continuing upward from the inner wall and rear side of the engaging grooves 67. The ribs 73 function to restrict rearward movement of the pinch roller holder 56. When the pinch roller holder 56 is supported on the holder support member 57 so as to be capable of moving in the short dimension of the holder support member 57 while the protruding pieces 68 are engaged with the engaging grooves 67, forward movement of the pinch roller holder 56 is restricted when the front ends of the protruding pieces 68 contact inner walls 67A on the front sides of the engaging grooves 67, and rearward movement of the pinch roller holder 56 is restricted by the rear ends of the protruding pieces 68 contacting the ribs 73. In the illustrative aspects, the movable range of the pinch roller holder 56 in the short dimension of the holder support member 57 is restricted between a conveying position and a retracted position. As shown in FIG. 11, the conveying position is the position of the pinch roller holder 56 when a line connecting the center of revolution O and the rotational center B of the pinch roller 48 on the rear side of the drive roller 47 forms an angle $\theta_1$ with a vertical plane passing through the center of revolution O, and the retracted position is the position of the pinch roller holder 56 when a line connecting the center of revolution O and the rotational center B of the pinch roller 48 forms an angle $\theta_2$ ($>\theta_1$) with the same vertical plane. With this configuration of the pinch roller holder 56 and holder support member 57, the pinch roller holder 56 moves to the conveying position when the conveying rollers 54 are pinching and conveying a recording paper, and moves to the retracted position when the trailing edge of the recording paper comes out of the conveying rollers 54.

The through-hole 76 is formed in the top surface 69 of the holder support member 57 for inserting the detection member 74. The through-hole 76 is formed through the bottom surface of the holder support member 57 and is elongated in the short dimension (the front-to-rear direction) of the holder support member 57. The length of the through-hole 76 in the short dimension of the holder support member 57 is sufficiently longer than the length of the detection member 74 in the same direction so that the detection member 74 can move in a range at least equal to the movable range of the pinch roller holder 56 supported on the holder support member 57.

With this construction of the pinch roller holder 56 and holder support member 57, the pinch roller holder 56 rollingly moves toward the conveying position when the recording paper is interposed in the conveying rollers 54. As the pinch roller holder 56 rollingly moves, the detection member 74 retracts from the optical path in the photointerrupter 75. Further, the pinch roller holder 56 rollingly moves toward the retracted position when the trailing edge of the recording paper leaves (separates from) the conveying rollers 54. As the pinch roller holder 56 rollingly moves, the detection member 74 moves into the optical path of the photointerrupter 75, blocking the transmission of light therein.

In this way, the multifunction device 1 detects the timing at which the recording paper becomes interposed between the conveying rollers 54 based on the movement of the pinch roller holder 56. Since the conveying rollers 54 (more specifically, the pinch rollers 48) immediately move in the paper-conveying direction when the paper becomes interposed between the conveying rollers 54, the leading edge of the paper is not bent backward or otherwise deformed. Therefore, this construction improves detection accuracy by preventing irregular detection timings caused by differences in the types of sheets, such as between thick paper and thin paper. Further, since the conveying position of the recording paper is detected based on the timing in which the paper is gripped by the conveying rollers 54, there are no irregularities in detection timing, even when different sheets of paper follow different paths due to differing degrees and directions of warpage in the leading edge of the paper.

Next, the rolling principle of the pinch roller holder 56 will be described with reference to FIGS. 12 and 13. FIG. 12 is an explanatory diagram illustrating a cross section of the drive roller 47 and pinch roller 48 in an XY coordinate system having the center of revolution O as the point of origin. Fig, 13 is an explanatory diagram showing the state of the recording paper interposed in the structure of FIG. 12. In these drawings, the drive roller 47 has a rotational center A and a radius r1, and the pinch roller 48 has a rotational center B and a radius r2. The rotational center A is positioned on the X-axis, with the point of origin O at a position separated a distance greater than the radius r1 of the drive roller 47 in the −X direction from the rotational center A. The point of origin O conforms to the center of a cylindrical path including the top surface 69, that is, the center of revolution O. The pinch roller holder 56 can rollingly move about the point of origin O between a position D rotated the angle $\theta_1$ from the X-axis in the counterclockwise direction, and a position E rotated an angle $\theta_2$ ($>\theta_1$) from the X-axis in the same direction. Here, the position D corresponds to the conveying position, while the position E corresponds to the retracted position. In other words, an imaginary plane (a plane including the X-axis and perpendicular to the surface of FIG. 13) including the rotational axis A of the drive roller 47 and the center of revolution O is defined, and the pinch roller holder 56 is rollingly movable about the center of revolution O between: the position D that is rotated the angle $\theta_1$ ($\theta_1 \geqq 0$ in the illustrative aspects) from the X-axis toward upstream in the conveying direction; and the position E, that is rotated the angle $\theta_2$ ($\theta_2 > \theta_1$) from the X-axis toward upstream in the conveying direction. For explanatory purposes, the centers O, A, and B shown in FIGS. 12 and 13 have been defined in the illustrative aspects, but it should be apparent that the center positions of the drive roller 47, pinch roller 48, and the curved top surface 69 are not limited to these positions.

In this description, an angle formed by line segments OA and OB when the pinch rollers 48 are moved to an arbitrary position will be referred to as θ, where the angle θ may fall within the range $\theta_1 \leqq \theta \leqq \theta_2$. The springs 61 accommodated in the pinch roller holder 56 in a compressed state urge the pinch rollers 48 toward the drive roller 47 (along the line segment AB).

As shown in the drawings, when $\theta >_0$, the center O of the arc DE does not match the center A of the drive roller 47 about which the pinch roller 48 moves. Therefore, as θ grows larger, the pinch roller holder 56 gradually separates from the drive roller 47, allowing the springs 61 to extend. Hence, an elastic energy E of the springs 61 decreases as θ grows larger. At this time, a moment M1 acts on the pinch rollers 48 in the counterclockwise direction about the center of rotation A, that is, a direction orthogonal to the line segment AB. The magnitude of the moment M1 is proportional to a decrease dE/dθ in the elastic energy E.

At the same time, a frictional force (frictional moment) M2' is produced in the pinch rollers 48 in the direction opposite this rotational direction about the rotational center B as the pinch rollers 48 follow the rotation of the drive roller 47. Here, M2 is defined as a moment found by converting the frictional force M2' to a force about the center of rotation A, that is, a direction orthogonal to the line segment AB. The frictional force M2' generated at this time is a static frictional force produced on the sliding surfaces of the pinch rollers 48 and rotational shafts 65 as the pinch rollers 48 rotate. The moment M2 is not indicated in FIG. 12.

Further, a rolling frictional force (frictional moment) M3' is generated when the pinch roller holder 56 rolls over the top surface 69 of the holder support member 57. The rolling frictional force M3' acts about the center O, that is, in a direction orthogonal to the line segment OB. M3 is defined as a moment obtained by converting the frictional force M3' to a force about the rotational center A, that is, in a direction orthogonal to the line segment AB. The moment M3 is not shown in FIG. 12.

Figure 13:
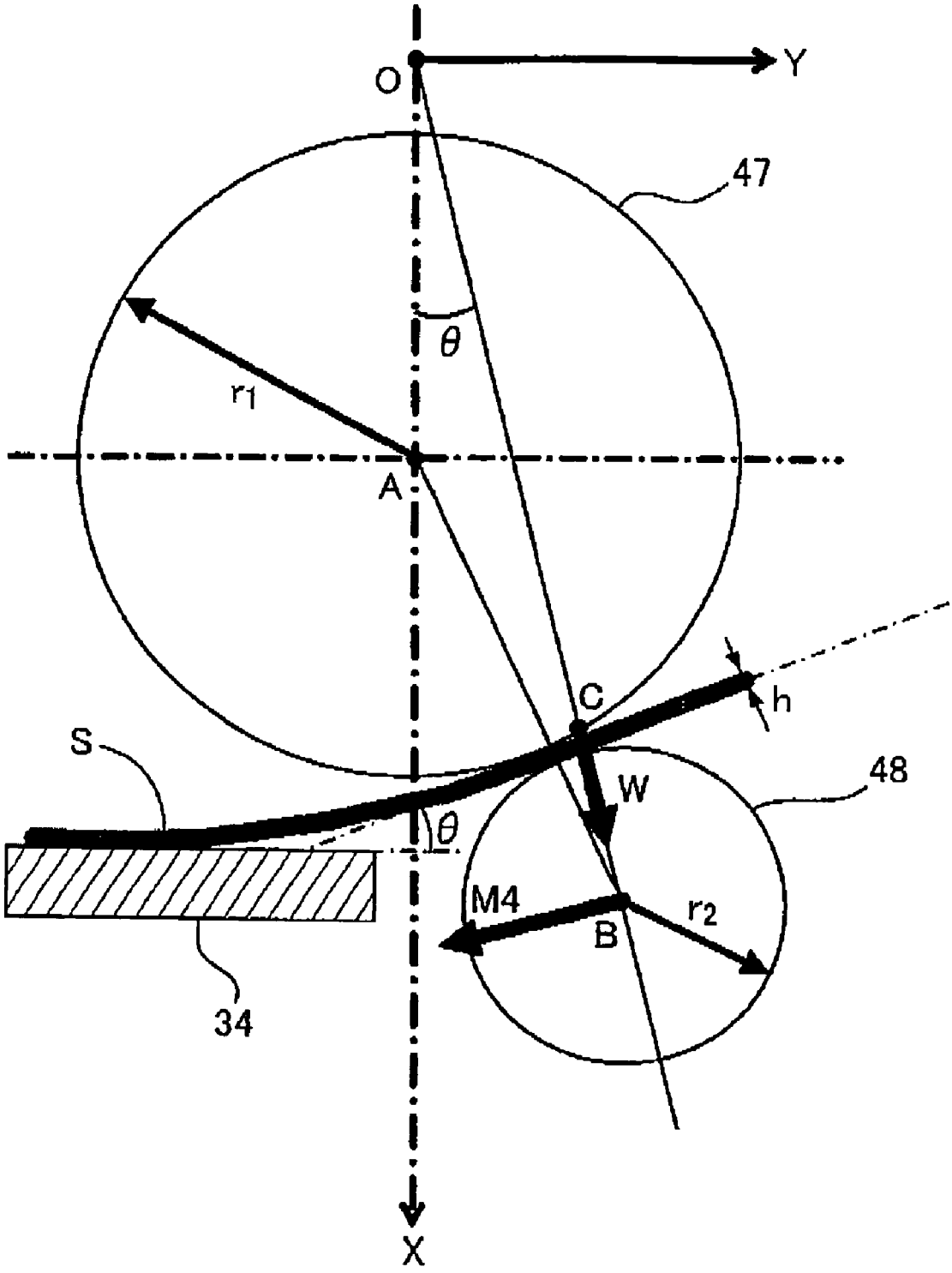
FIG. 13 is an explanatory diagram showing the state of the recording paper interposed in the structure of FIG. 12.

As shown in FIG. 13, a force W produced by the weight of the recording paper, an elastic force caused by flexing in the recording paper, and the like acts toward the center of the pinch rollers 48 when the drive roller 47 and pinch roller 48 convey the recording paper. This force W generates a moment M4 in a direction where θ becomes smaller. As shown in FIG. 13, since the recording paper is conveyed toward the platen 34 at an angle θ above the platen 34 so as to press the paper against the platen 34, the moment M4 produced by the force W cannot be ignored. In this example, EI signifies the stiffness of the recording paper.

Further, the length of the springs 61 change by a thickness h of the recording paper when the leading edge of the paper becomes interposed between the drive roller 47 and pinch roller 48 or when the trailing edge comes out from the drive roller 47 and pinch roller 4B. Specifically, when the leading edge becomes interposed between the drive roller 47 and pinch roller 48, the springs 61 are contracted by the thickness h, and when the trailing edge leaves the drive roller 47 and pinch roller 48, the springs 61 expand by the thickness h. Consequently, the elastic energy of the spring 61 also fluctuates at this time, producing a moment M5 about the rotational center A of a magnitude proportional to dE/dθ, similar to the moment M1 described above.

Since the angle θ ($\theta_1 \leqq \theta \leqq \theta_2$), the thickness h of the recording paper, and the stiffness EI of the recording paper are variables, the moment M1 can be expressed by a function of θ and h, the moment M4 by a function of θ and EI, and the moment M5 as a function of h. While the moments M2 and M3 are also strictly speaking a function of θ and h, these values are much smaller than the moments M1, M4, and M5 and will be treated as constants here. Hereinafter, functions of the angle θ will be expressed as M1(θ) and M4 (θ).

In the illustrative aspects, the moments M1 through M5 must satisfy the following equations, assuming that no slippage occurs between the drive roller 47 and pinch roller 48 and that the frictional force between the drive roller 47 and pinch roller 48 and the frictional force between the pinch roller 48 and recording paper are sufficiently large.

Equation (1) applies when the drive roller 47 and pinch roller 48 are not conveying the recording paper. Here, the moment M2 acts in the clockwise direction around the rotational center A, while the moment M3 acts counterclockwise around the rotational center A.

$$M1(\theta)+M3>M2 \tag{1}$$

In this case, the pinch roller holder 56 retracts rearward while rolling upstream in the paper-conveying direction, and is maintained in the retracted position of $\theta=\theta_2$.

When the recording paper arrives at the nip part between the drive roller 47 and pinch roller 48 and the leading edge of the recording paper is gripped by the rotating drive roller 47, the function of equation (2) below applies. At this time, the moment M3 acts counterclockwise around the rotational center A, while the moment M5 acts clockwise around the rotational center A.

$$M1(\theta)+M3<M4(\theta)+M5 \quad (2)$$

At this time, the pinch roller holder 56 rolls downstream in the paper-conveying direction and is maintained in the conveying position of $\theta=\theta_1$.

The function in equation (3) below applies when the recording paper is being conveyed. At this time, the moment M2 acts clockwise around the rotational center A, while the moment M3 also acts clockwise around the rotational center A.

$$M1(\theta)<M2+M3+M4(\theta) \quad (3)$$

Hence, the pinch roller holder 56 continues to be maintained in the conveying position of $\theta=\theta_1$.

When the trailing edge of the recording paper comes out of the nip part between the drive roller 47 and pinch roller 48, the following equation (4) applies. At this time, the moment M3 acts clockwise around the rotational center A, while the moment M5 acts counterclockwise around the rotational center A, as with the moment M1.

$$M1(\theta)+M5>M3 \quad (4)$$

As can be seen from equation (4), only a moment M3 (right-hand side) acts as a frictional force in response to the moment M1(θ)+M5 (left-hand side) produced when the trailing edge of the paper leaves the nip part between the drive roller 47 and pinch roller 48. However, since the moment M1(θ)+M5 for rolling toward the upstream side in the paper-conveying direction is greater than the moment M3 for preventing this movement, the pinch roller holder 56 rollingly moves toward the upstream side. Here, the moment M3 is a slight frictional force generated by the roller bearing 80. In other words, the moment M3 is very small compared to the moment M1(θ)+M5. Therefore, nearly all of the moment M1(θ)+M5 acts to move the pinch roller holder 56 toward the upstream side. Hence, the pinch roller holder 56 is rollingly moved quickly. Once the pinch roller holder 56 is retracted to the retracted position, the pinch roller holder 56 is maintained in the retracted position of $\theta=\theta_2$.

The following equation (5) applies when rotating the drive roller 47 in reverse after the trailing edge of the recording paper has left the drive roller 47 and pinch roller 48, and even during abnormal cases in which the pinch roller holder 56 does not return to the retracted position of $\theta=\theta_2$, thereby enabling the pinch roller holder 56 to roll to the retracted position of $\theta=\theta_2$.

$$M1(\theta)+M2>M3 \quad (5)$$

In this case, the moment M2 acts counterclockwise around the rotational center A, and the moment M3 acts clockwise around the center O.

In the multifunction device 1 described above, the pinch roller holder 56 is rollingly supported via the roller bearing 80. By providing the pinch rollers 48, pinch roller holder 56, the holder support member 57, springs 61, and the like, the pinch roller holder 56 immediately rollingly moves downstream in the conveying direction when the recording paper is gripped by the conveying rollers 54, as established by the above equations (1)-(5). When the recording paper leaves the grip of the conveying rollers 54, the pinch roller holder 56 immediately rollingly moves upstream in the conveying direction. Consequently, the detection member 74 immediately retracts from the photointerrupter 60, enabling the conveyed position of the recording paper to be detected quickly and accurately.

While the invention has been described in detail with reference to the above aspects thereof, it would be apparent to those skilled in the art that various changes and modifications may be made therein without departing from the spirit of the invention. For example, if a drive roller and follow roller designed for another purpose than to convey the recording paper are provided on the conveying path 23 in addition to the conveying rollers 54, the invention can be applied to this follow roller. It should also be apparent that the invention may be applied to a pair of conveying rollers provided on an original conveying path formed in the ADF 6 and is not limited to the conveying path in the multifunction device 1.

What is claimed is:

1. A sheet detecting device for detecting a position of a recording medium, comprising:

a follow roller disposed on a conveying path along which a recording medium is conveyed in a conveying direction, the follow roller receiving a rotational force of a drive roller and following rotation of the drive roller;

an urging member that applies an urging force to the follow roller for urging the follow roller toward the drive roller;

a first support member;

a second support member that rotatably supports the follow roller and that supports the urging member, the second support member being supported on the first support member, allowing the second support member to move to a first position when the drive roller and the follow roller nippingly convey the recording medium, and allowing the second support member to move to a second position upstream of the first position in the conveying direction when the recording medium is separated from the drive roller and the follow roller, the second support member being provided with a detection member that moves with the second support member when the second support member moves between the first position and the second position; and a detecting unit that detects the detection member, thereby detecting the position of the recording medium;

wherein the first support member supports the second support member via a rolling bearing, allowing the second support member to rollingly move between the first position and the second position.

2. The sheet detecting device according to claim 1, wherein the detecting unit has a light-emitting element that emits light, and a light-receiving element that receives light emitted from the light-emitting element and traveling along an optical path; and wherein the detecting unit detects presence of the detection member that enters and recedes from the optical path based on changes in an amount of light received by the light-receiving element.

3. The sheet detecting device according claim 1;

wherein the second support member has a support part; and wherein the first support member comprises:

a supporting surface that supports the support part of the second support member via the rolling bearing;

a first restricting member that restricts rolling of the second support member at the first position; and a second restricting member that restricts rolling of the second support member at the second position.

4. The sheet detecting device according claim 3;

wherein the rolling bearing comprises a plurality of rotary bodies interposed in a freely rotating state between the supporting surface of the first support member and the support part of the second support member.

5. The sheet detecting device according claim 1;

wherein the first support member supports the second support member such that the second support member gradually separates from the drive roller as the second support member rollingly moves from the first position to the second position.

6. The sheet detecting device according claim 5;

wherein the second support member rollingly moves about a center of revolution parallel to a rotational axis of the drive roller.

7. The sheet detecting device according claim 6;

wherein an imaginary plane including the rotational axis of the drive roller and the center of revolution is defined; and wherein the second support member is rollingly movable about the center of revolution between:

the first position that is rotated a first angle from the imaginary plane toward upstream in the conveying direction; and the second position that is rotated a second angle from the imaginary plane toward upstream in the conveying direction;

where the first angle is greater than or equal to zero and the second angle is greater than the first angle.

8. The sheet detecting device according claim 1;

wherein the supporting surface of the first support member is formed in a shape that substantially conforms to an outer peripheral surface of a predetermined cylindrical path around the center of revolution.

9. The sheet detecting device according claim 1;

wherein the second support member integrally supports a plurality of follow rollers at predetermined intervals along an axial direction of the drive roller.

10. The sheet detecting device according claim 1;

wherein the first support member is formed with a through-hole that is elongated in the conveying direction; and wherein the detection member is inserted through the through-hole and is movable within the through-hole in the conveying direction.

* * * * *

UNITED STATES PATENT AND TRADEMARK OFFICE

CERTIFICATE OF CORRECTION

PATENT NO. : 7,591,467 B2
APPLICATION NO. : 11/540178
DATED : September 22, 2009
INVENTOR(S) : Kohei Terada It is certified that error appears in the above-identified patent and that said Letters Patent is hereby corrected as shown below:

Column 20, line 6, change the dependency of Claim 8 from Claim 1 to Claim 6. Please replace Claim 8 as follows:

Claim 8 The sheet detecting device according to Claim 6;
wherein the supporting surface of the first support member is formed in a shape that substantially conforms to an outer peripheral surface of a predetermined cylindrical path around the center of revolution.

Signed and Sealed this
Seventeenth Day of July, 2012

David J. Kappos

David J. Kappos
*Director of the United States Patent and Trademark Office*